US008083644B2

(12) United States Patent
Purdy et al.

(10) Patent No.: US 8,083,644 B2
(45) Date of Patent: Dec. 27, 2011

(54) RESISTANCE GARMENTS AND ACTIVE MATERIALS

(76) Inventors: Peter Purdy, Bend, OR (US); Luke Purdy, Bend, OR (US); Matthew Creedican, Bend, OR (US)

( * ) Notice: Subject to any disclaimer, the term of this patent is extended or adjusted under 35 U.S.C. 154(b) by 0 days.

(21) Appl. No.: 12/634,519

(22) Filed: Dec. 9, 2009

(65) Prior Publication Data

US 2010/0144490 A1 Jun. 10, 2010

Related U.S. Application Data

(63) Continuation-in-part of application No. 11/441,568, filed on May 26, 2006, now abandoned.

(60) Provisional application No. 60/750,432, filed on Dec. 14, 2005.

(51) Int. Cl.
*A63B 24/00* (2006.01)
*A63B 21/065* (2006.01)

(52) U.S. Cl. ..... 482/4; 482/105; 2/905

(58) Field of Classification Search ..... 482/4, 5, 482/105, 124, 139, 148; 2/905
See application file for complete search history.

(56) References Cited

U.S. PATENT DOCUMENTS

| | | | | |
|---|---|---|---|---|
| 2,664,566 | A | 1/1954 | Mianulli | |
| 4,065,814 | A | 1/1978 | Fox | |
| 4,862,878 | A | 9/1989 | Davison et al. | |
| 4,875,677 | A | 10/1989 | Tetreault | |
| 5,176,600 | A | 1/1993 | Wilkinson | |
| 5,186,701 | A | 2/1993 | Wilkinson | |
| 5,306,222 | A | 4/1994 | Wilkinson | |
| 5,465,428 | A | 11/1995 | Earl | |
| 5,472,412 | A | 12/1995 | Knoth | |
| 5,553,322 | A | 9/1996 | Cebo-Johnson | |
| 5,662,595 | A | 9/1997 | Chesher et al. | |
| 5,683,353 | A | 11/1997 | Hamersly | |
| 5,720,042 | A | 2/1998 | Wilkinson | |
| RE35,940 | E * | 10/1998 | Heinz et al. | 602/19 |
| 5,937,441 | A | 8/1999 | Raines | |
| 6,210,354 | B1 | 4/2001 | Ousdal | |
| 6,397,496 | B1 | 6/2002 | Seymour | |
| 6,530,868 | B1 | 3/2003 | Pape | |
| 6,757,916 | B2 * | 7/2004 | Mah et al. | 2/456 |

(Continued)

OTHER PUBLICATIONS

U.S. Appl. No. 11/441,568 Notice of Allowance dated Sep. 9, 2009, 6 pages.

(Continued)

*Primary Examiner* — Allana Lewin
(74) *Attorney, Agent, or Firm* — Lathrop & Gage LLP

(57) ABSTRACT

Resistance garments include for example a first cuff and a second cuff that circumscribe a portion of a wearer's body; an adjustment device fixedly attached to the first cuff; and a resistive element connecting the first cuff and the second cuff, and coupling with the adjustment device. An active material includes a backing fabric and one or more length-adjusting devices, that each include a first filament and a second filament that are interwoven with the backing fabric and substantially parallel with one another, and one or more motors. Each of the motors drives first and second spooling elements that alternatively reel in or reel out portions of the first and second filaments, respectively. The reeling in or out thereby adjusts (a) a length of the filaments, (b) a length of the length-adjusting device corresponding to the at least one motor, and (c) a length of the active material.

19 Claims, 34 Drawing Sheets

U.S. PATENT DOCUMENTS

| | | | | |
|---|---|---|---|---|
| 6,954,968 | B1 * | 10/2005 | Sitbon | 24/303 |
| 7,845,023 | B2 * | 12/2010 | Swatee | 2/272 |
| 2004/0116260 | A1 | 6/2004 | Drennan | |
| 2006/0094989 | A1 * | 5/2006 | Scott et al. | 601/5 |
| 2007/0135279 | A1 * | 6/2007 | Purdy et al. | 482/124 |
| 2007/0265140 | A1 * | 11/2007 | Kim et al. | 482/8 |
| 2010/0275338 | A1 * | 11/2010 | Hyde et al. | 2/69 |

OTHER PUBLICATIONS

U.S. Appl. No. 11/441,568 Response to Office Action filed May 14, 2009, 8 pages.

U.S. Appl. No. 11/441,568 Office Action dated Nov. 14, 2008, 10 pages.

U.S. Appl. No. 11/441,568 Response to Office Action filed Jul. 10, 2008, 10 pages.

U.S. Appl. No. 11/441,568 Office Action dated Apr. 24, 2008, 9 pages.

U.S. Appl. No. 11/441,568 Supplemental After Final Amendment filed Apr. 1, 2008, 7 pages.

U.S. Appl. No. 11/441,568 Advisory Action dated Mar. 6, 2008, 3 pages.

U.S. Appl. No. 11/441,568 After Final Amendment filed Feb. 12, 2008, 6 pages.

U.S. Appl. No. 11/441,568 Office Action dated Dec. 12, 2007, 6 pages.

U.S. Appl. No. 11/441,568 Response to Office Action filed Sep. 28, 2007, 8 pages.

U.S. Appl. No. 11/441,568 Office Action dated Mar. 29, 2007, 7 pages.

U.S. Appl. No. 11/441,568 Response to Restriction Requirement filed Mar. 19, 2007, 6 pages.

U.S. Appl. No. 11/441,568 Restriction Requirement dated Feb. 15, 2007, 5 pages.

Melville, K., Physicists Build Nano Motor, Jul. 27, 2003, 3 pages.

Namiki, product catalog, accessed from the Internet on Feb. 15, 2010 http://www.namiki.net/product/kbo/dc/pdf/motor_gear_full_en.pdf, 39 pages.

MicroMo Electronics, Quickshaft Linear DC Servomotor, 2009, accessed from the Internet on Feb. 15, 2010 http://www.micromo.com/sprache2/n112782/i426242.html, 1 page.

Berkely Lab, Powerful Linear Nanomotor, 2009, accessed from the Internet on Feb., http://www.lbl.gov/tech-transfer/techs/lbnl2011.html, 2 pages.

* cited by examiner

RESISTANCE GARMENTS AND ACTIVE MATERIALS

RELATED APPLICATIONS

This application is a continuation-in-part application of, and claims the benefit of priority to, commonly owned and copending U.S. patent application Ser. No. 11/441,568, filed May 26, 2006 now abandoned, which claims the benefit of priority to U.S. Provisional Patent Application No. 60/750,432, filed Dec. 14, 2005. Both of the above-identified patent applications are incorporated herein by reference in their entireties.

BACKGROUND

A resistance garment worn by a person during aerobic activity may provide greater muscle tone and increased caloric output than would otherwise be possible within a given time period. These increased benefits of physical exertion may, for example, be expressed as improved athletic performance, expedited recovery from injury, and/or maintenance of fitness and health.

Several resistance garments have been described. For example, U.S. Pat. No. 4,065,814, titled "One piece elastic body suit", discloses a jumpsuit having outer and inner cloth sections with elastic band members disposed between the cloth sections. A pair of elastic band members runs from the back of the ankles, over the shoulders, to the front of the ankles in a parallel fashion. Another elastic member encircles the waist.

U.S. Pat. No. 5,465,428, titled "Exercise device of adjustable resistance for flexing of muscles of the legs and torso", discloses an elasticized garment having an inverted U-shape. The center of the garment is attached to a rear waist portion of the wearer. A pair of elongated, descending members falls over the hamstrings and attaches above each of the wearer's knees. The garment is especially designed for walking or running where the descending members resist the forward motion of the wearer's legs.

U.S. Pat. No. 5,176,600, titled "Aerobic resistance exercise garment", discloses a garment including stretchable, elastic webbing between each arm and the torso, and also interconnecting the leg portions with each other. The garment further includes a plurality of pockets to hold optional weights.

U.S. Pat. Nos. 5,186,701, 5,306,222 and 5,720,042 disclose garments having a compressive structure, for better muscular alignment and less muscle fatigue, combined with longitudinal resistive elements, such as elastic bands, strips or cords. The compressive structure may be a series of compressive cuffs, or a suit made in whole or part of a compressive material, such as Lycra®. Resistive bands may be attached to anchor points on the compressive cuffs, gloves or socks/shoes.

SUMMARY

In one embodiment, a resistance garment includes a first cuff and a second cuff, the first cuff and the second cuff circumscribing a portion of a wearer's body; an adjustment device fixedly attached to the first cuff; and a resistive element connecting the first cuff and the second cuff, wherein the resistive element couples with the adjustment device.

In one embodiment, a method of providing a resistance garment to increase the benefits of physical exertion includes applying a first cuff and a second cuff to a wearer's body, the first cuff and the second cuff circumscribing a portion of the wearer's body; providing an adjustment device fixedly attached to the first cuff; and connecting the adjustment device of the first cuff and the second cuff with a resistive element.

In one embodiment, a resistance garment includes at least one resistive plate device to be worn by a person, the resistive plate device having a plurality of baffles, wherein each baffle is secured to at least one neighboring baffle by a rubberized material.

In one embodiment, a resistance garment includes a first cuff disposed at a distal end of a body part; a second cuff disposed at a proximal end of the body part; and a rod connecting the first cuff and the second cuff.

In one embodiment, an active material includes a backing fabric and one or more length-adjusting devices. Each of the length-adjusting devices includes a first filament and a second filament that are interwoven with the backing fabric and substantially parallel with one another, and one or more motors. Each of the motors drives first and second spooling elements that alternatively reel in or reel out portions of the first and second filaments, respectively. The reeling in or out thereby adjusts (a) a length of the filaments, (b) a length of the length-adjusting device corresponding to the at least one motor, and (c) a length of the active material.

In an embodiment, a method for adjusting a length of a material includes integrating one or more length-adjusting devices with a backing fabric. Each length-adjusting device includes (a) a first filament and a second filament substantially parallel with one another, and (b) one or more motors, each motor driving first and second spooling elements that alternatively reel in or reel out portions of the first and second filaments, respectively. Transmitting power to at least one of the motors causes the motor(s) to reel in or reel out portions of the filaments, thereby adjusting a length of the filaments, a length of the length-adjusting device corresponding to the at least one motor, and a length of the material.

In an embodiment, a resistance garment includes a first cuff and a second cuff, the first cuff and the second cuff circumscribing a portion of a wearer's body. An adjustment device is fixedly attached to the first cuff. A resistive element connects the first cuff and the second cuff, and couples with the adjustment device. The adjustment device includes (a) an automated resistance device having an antennae for communicating with a second adjustment device via wireless signals, and (b) a central processing unit for receiving and evaluating instructions and data.

In an embodiment, a resistance garment includes at least one of sleeves and legs, each of the sleeves and legs having a plurality of length-adjusting devices that substantially encircle arms or legs, respectively, of a wearer. The resistance garment also includes means for controlling contraction of the length-adjusting devices so as to ripple a squeezing action of the sleeves or legs outwardly from and inwardly toward a torso of the wearer.

BRIEF DESCRIPTION OF THE DRAWINGS

FIG. 30 illustrates a fragment of an active material that utilizes motors that include protrusions to anchor the motors to a backing fabric, in accord with an embodiment.

DETAILED DESCRIPTION OF THE DRAWINGS

Resistance garments may be worn by a person during exercise and/or during daily activities. For example, athletes may combine strength training with cardiovascular training by wearing a resistance garment during an aerobic activity. In another example, a form-fitting resistance garment may be worn under a person's everyday clothes, and the applied resistance may help a sedentary person, or a person experiencing reduced gravity (e.g., an astronaut), to maintain muscle tone.

Reference will now be made to the attached drawings, where like numbers represent similar elements in multiple figures. Numbering without parentheses is used to denote a genus (e.g., resistive elements 110), whereas numbering with parentheses denotes a species within a genus (e.g., resistive element 110(2)). Multiple elements within a figure may not be labeled for the sake of clarity.

Figure 1:
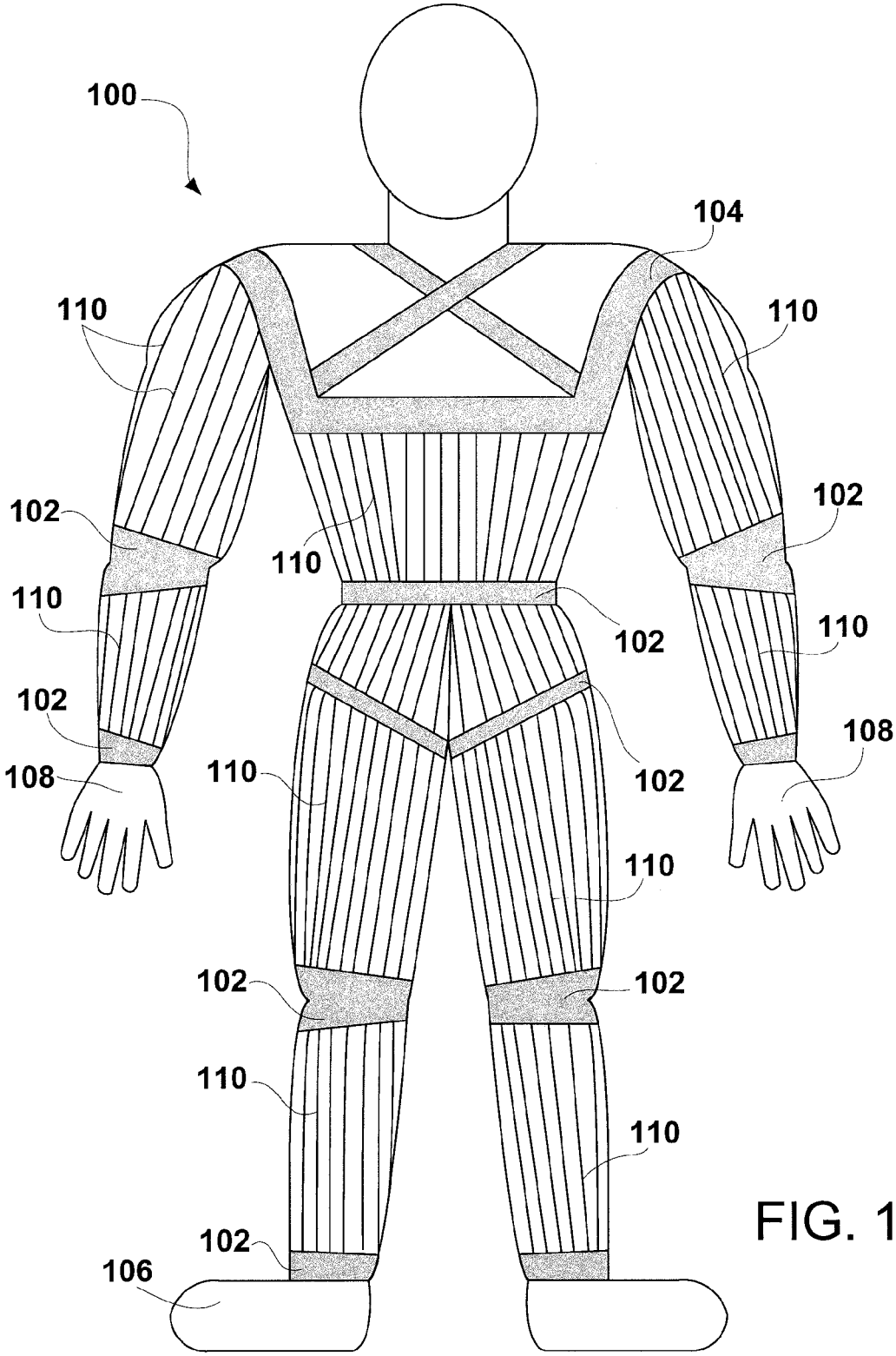
FIG. 1 shows a non-adjustable resistance garment.

FIG. 1 shows a non-adjustable resistance garment 100. Resistance garment 100 includes a plurality of cuffs 102 that each circumscribe a portion of a wearer's body. Cuffs 102 may themselves form independent items of clothing, they may form a distinct part of a larger item of clothing, or they may form an indistinguishable portion of an item of clothing. In one embodiment, cuffs 102 may be fabricated from a stiff, semi-flexible plastic, such as polyethylene or polyvinylchloride. The circumference of a plastic cuff may be adjusted by one or more fasteners. In another embodiment, cuffs 102 may be fabricated from a compressive material, such as rubber or spandex. Generally, cuffs 102 should be stiff enough to support any components mounted thereon and secured to the body such that they do not become significantly displaced when a longitudinal force is applied thereto. Resistive elements 110 are fixedly secured to cuffs 102 and may, for example, be elastomeric fibers, cords or straps. Optionally, cuffs 102 worn on the wrists may be attached to gloves 108 or thumb stirrups; cuffs 102 worn on the ankles may be attached to foot coverings 106 (e.g., shoes, socks, booties, foot stirrups); and a harness 104 may be worn around the chest and shoulders to secure resistive elements 110 to the torso of a wearer. As shown and described, resistance garment 100 provides a constant amount of resistance set by the elasticity of non-adjustable resistive elements 110.

It may, however, be desirable to alter the level of applied resistance from day-to-day or even during the course of a workout. For example, as a person becomes stronger through the use of a resistance garment, it may be necessary to increase resistance in order to continue to provide the benefits of resistance training. In another example, a person may warm-up at the beginning of a workout using light resistance and then increase the resistance as the workout progresses.

Figure 2:
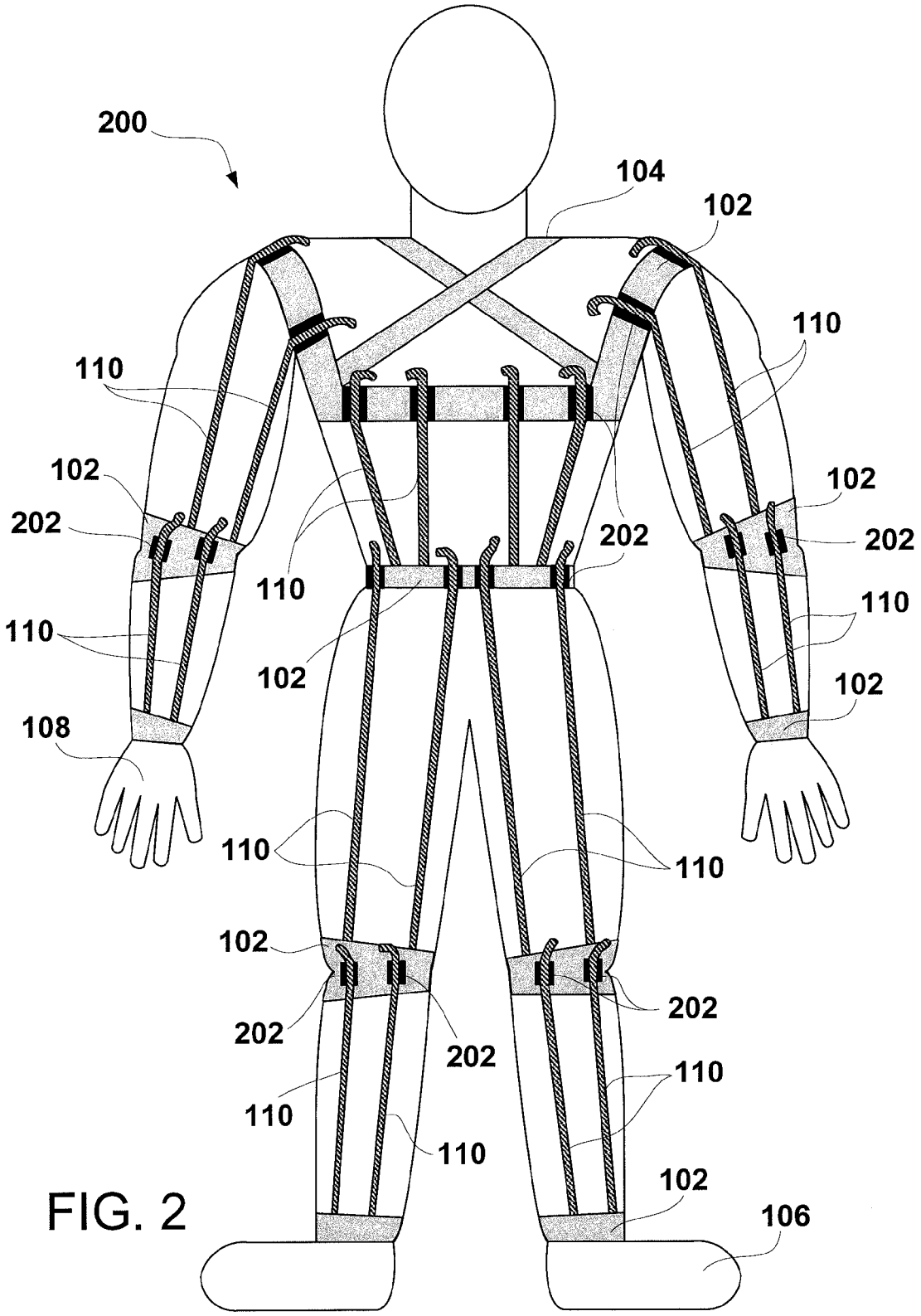
FIG. 2 shows a manually adjustable resistance garment according to one embodiment.

FIG. 2 shows a manually adjustable resistance garment 200. Resistance garment 200 includes a plurality of cuffs 102 that anchor resistive elements 110. In one embodiment, resistive elements 110 are sewn or otherwise permanently attached to a cuff 102 at a distal part of an appendage, while a cuff 102 at a proximal part of an appendage contains an adjustment device 202. In another embodiment, all cuffs 102 in resistance garment 200 contain adjustment devices 202, which provide for rapid, on-the-fly adjustments in the tension of resistive elements 110. One or both ends of resistive element 110 may be secured by adjustment devices 202. For example, adjustment devices 202 may be clam cleats that hold resistive elements 110 in the form of dynamic ropes, or active cables as described below (see FIG. 34). In another example, adjustment devices 202 may be hooks that hold resistive elements 110 in the form of fibers having eyelets that fit over the hooks. It will be appreciated that other adjustment devices 202 that fall within the spirit and scope of those described above may form part of resistance garment 200.

Figure 3:
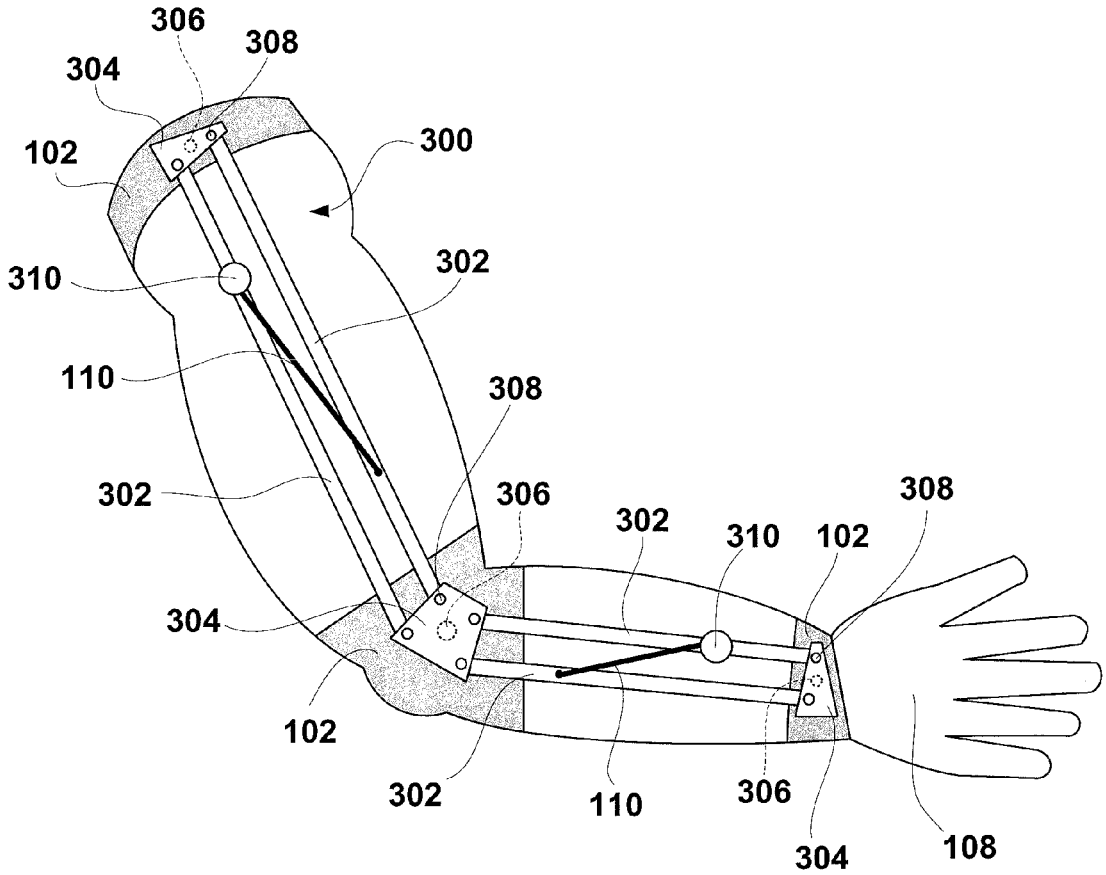
FIG. 3 shows an arm portion of a resistance garment incorporating an adjustable rod mechanism according to one embodiment.

FIG. 3 shows an arm portion of a resistance garment having an adjustable rod mechanism 300. Rod mechanism 300 includes a plurality of rods 302 that are anchored to cuffs 102 by securing means 304. Securing means 304 may freely rotate around a central axis 306, and rods 302 may pivot with respect to rivets 308. Neighboring rods 302 may be connected by one or more resistive elements 110, and the tension of resistive elements 110 may be adjusted, for example, by turning a knob 310 that is connected to a terminal end of resistive element 110. It will be appreciated that tensioning devices other than knobs 310 may be used, and that both ends of a resistive element 110 may be connected to tensioning devices.

Figure 4:
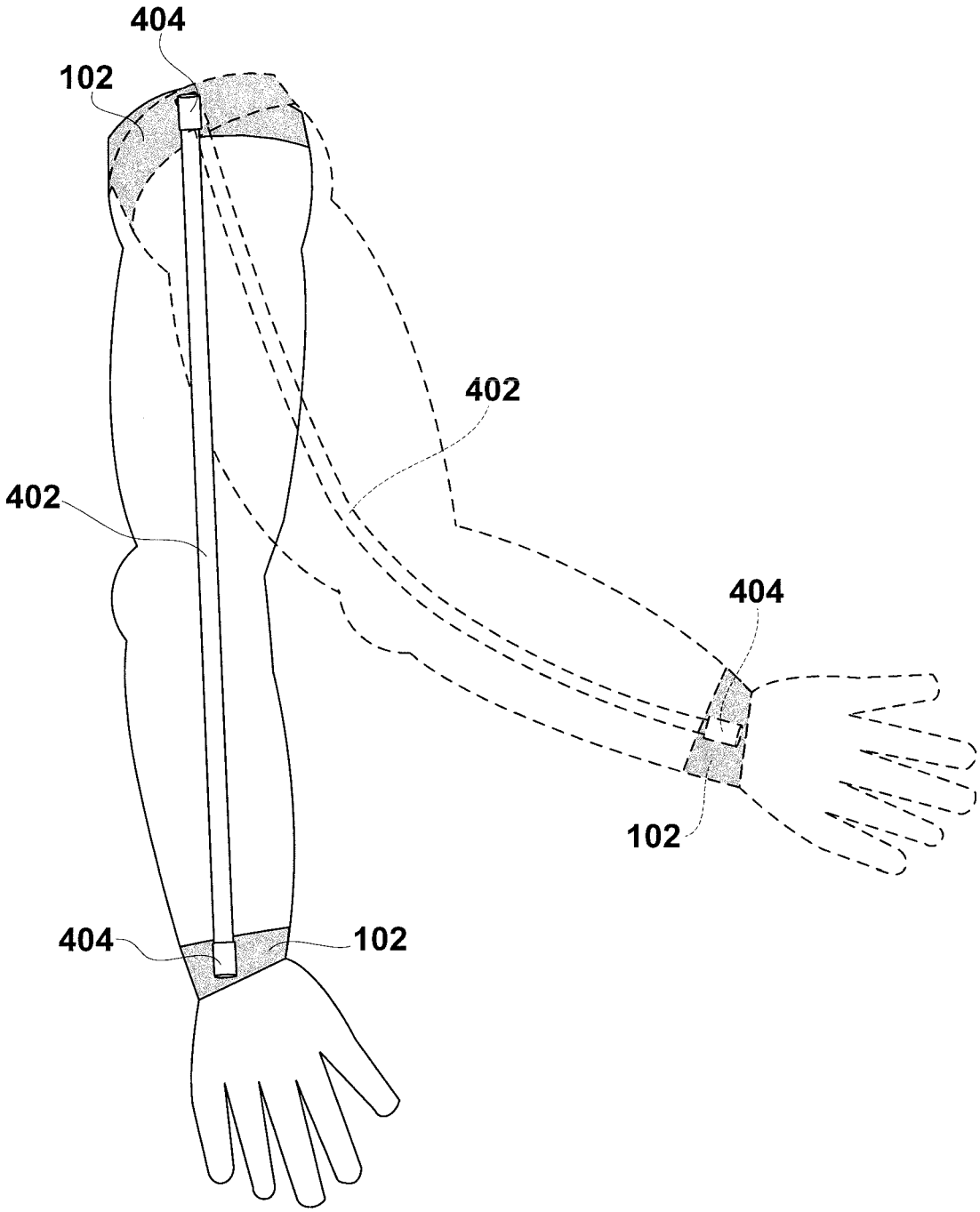
FIG. 4 shows an arm portion of a resistance garment incorporating a flexible rod mechanism according to one embodiment.

In an alternate embodiment, shown in FIG. 4, one or more rods 402 having flexibility along a longitudinal axis may be attached to cuffs 102. The one or more rods 402 may be fixedly attached to the cuffs, or they may be attached by securing means 404. Securing means 404 may allow rods 402 to be interchanged so that resistance may be altered as desired. Suitable securing means 404 include, for example, a plastic or metal socket disposed on a cuff for receiving an end of the flexible rod, a pin for penetrating a hole provided in the end of the flexible rod, and other means known in the art. As shown by the dashed outline in FIG. 4, flexible rod(s) 402 bend to provide resistance that is determined by the radius or thickness of the rod and the modulus of elasticity of the fabrication material. In one example, a flexible rod 402 is fabricated from fiberglass, carbon fiber and/or carbon nanotubes.

Figure 5:
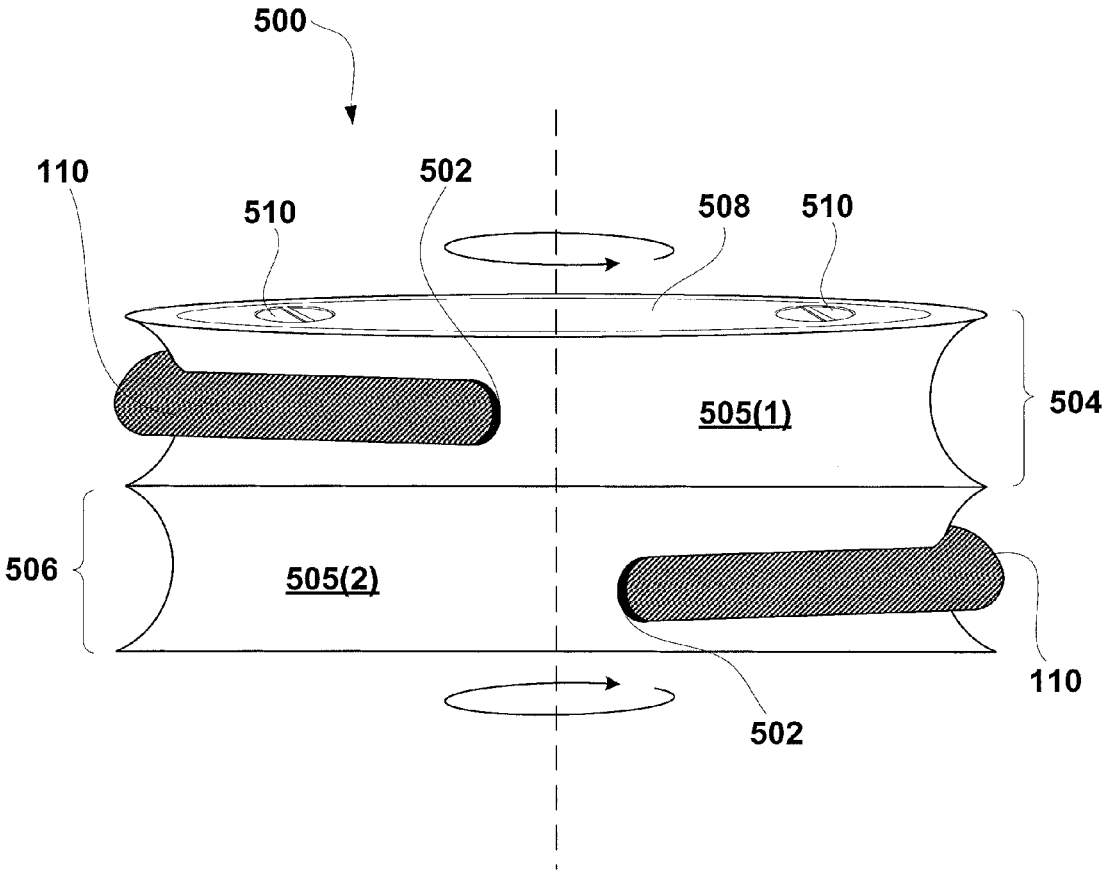
FIG. 5 shows a side perspective view of a ratchet pulley according to one embodiment.
Figure 6:
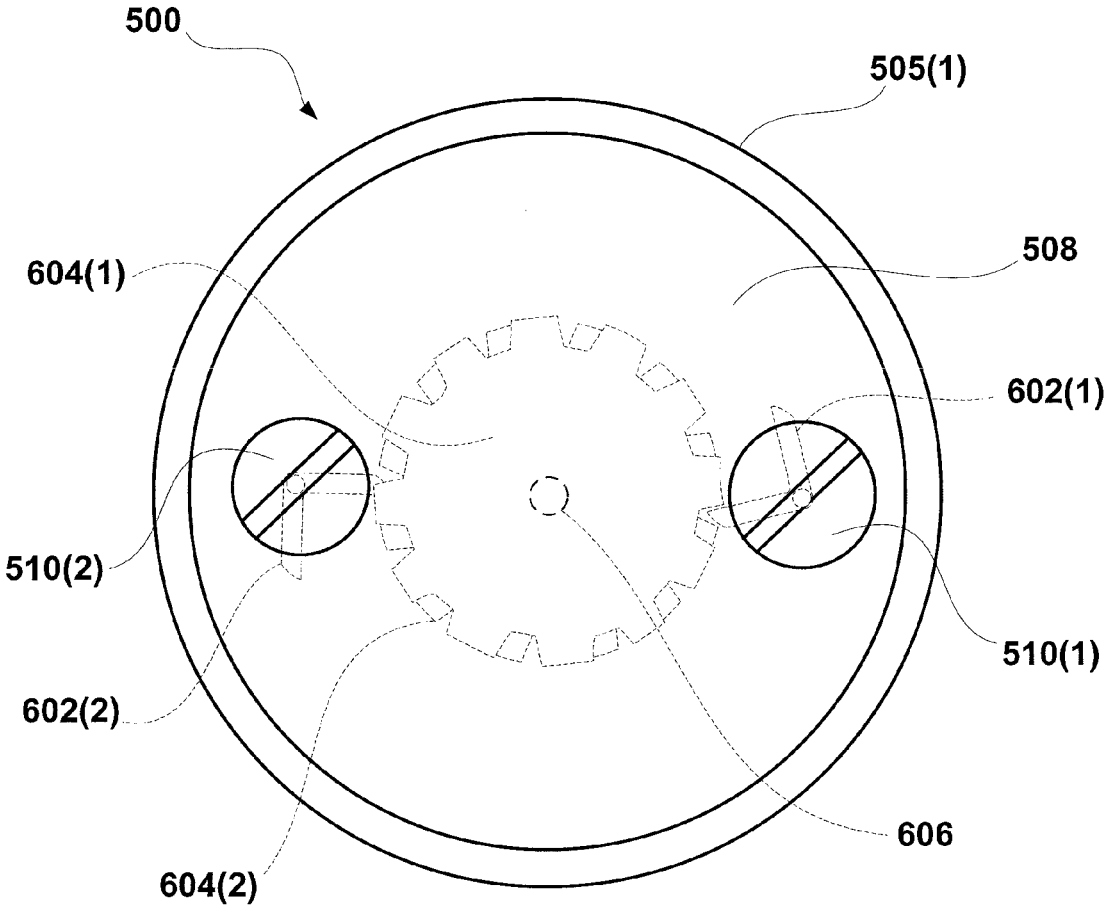
FIG. 6 shows a top plan view of the ratchet pulley of FIG. 5.
Figure 7:
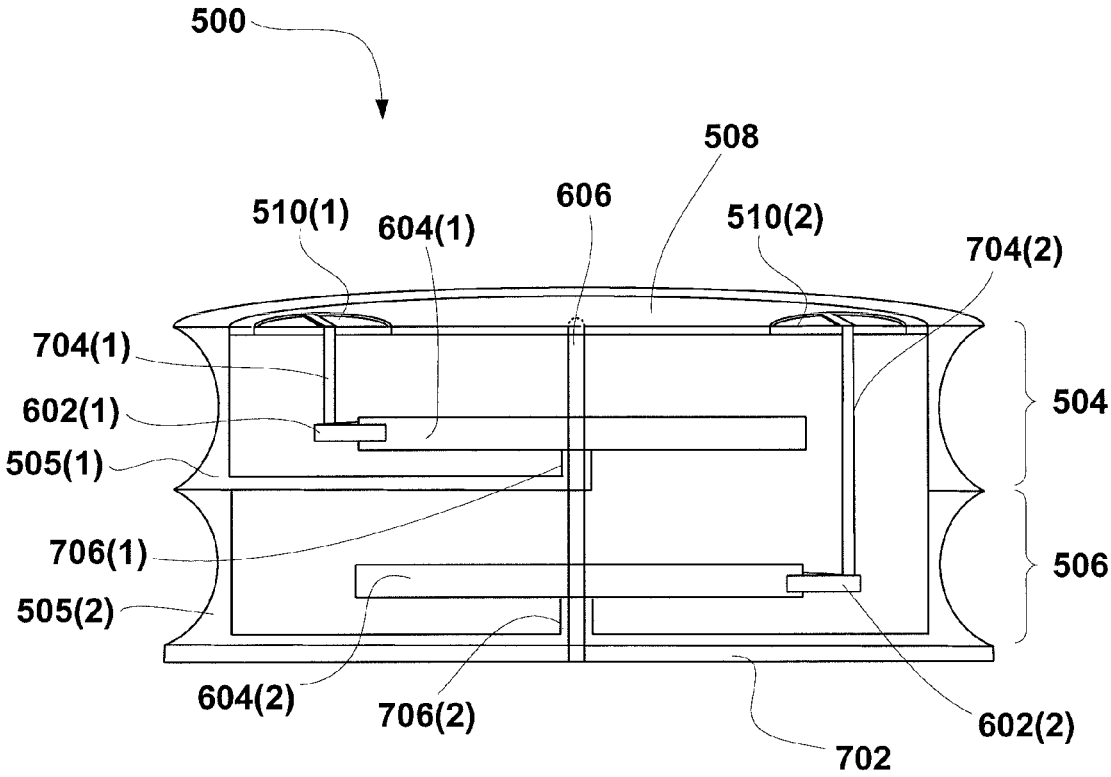
FIG. 7 shows a cross-sectional side view of the ratchet pulley of FIGS. 5 and 6.

Another adjustment device that is contemplated for use with the resistance garments described herein is a novel ratchet pulley. FIG. 5 shows a side perspective view of a ratchet pulley 500. Ratchet pulley 500 as shown is a dual pulley having a top layer 504 and a bottom layer 506, where a housing 505(1) and 505(2) of each layer 504, 506 rotates independently in opposite (or similar) directions. Each housing 505 holds a resistive element 110 threaded through a hole 502 and fixedly secured inside housing 505, e.g., by tying resistive element 110 into a knot inside housing 505. Holes 502 may be drilled at regular intervals around the circumference of housing 505 to provide versatile and/or multiple attachment positions. Further, multiple rows of holes may be drilled in housing 505 of each layer 504, 506. Ratchet pulley 500 also includes a cap 508 that includes engaging/disengaging mechanisms 510. The top plan view of FIG. 6 provides greater detail of the ratchet pulley of FIG. 5. Cap 508 does not rotate, but each of engaging/disengaging mechanisms 510(1) and 510(2) rotates independently within cap 508 to move a clutch 602, which engages or disengages a gear 604. Gears 604(1) and 604(2) rotate around central axle 606. FIG. 7 shows a cross-sectional side view of ratchet pulley 500. It can be seen that gears 604(1) and 604(2) are stacked vertically along central axle 606. Central axle 606 is fixedly attached to base 702 to prevent cap 508 from rotating. Cap 508 contains engaging/disengaging mechanisms 510, which operate clutches 602 via clutch axles 704. Each gear 604 is attached to housing 505 of its respective layer 504, 506 through an auxiliary axle 706. Thus, gear 604(1), for example, rotates when housing 505(1) rotates. Gear 604(1), housing 505(1) and resistive element(s) 110 attached thereto are locked into place by clutch 602(1). Gear 604(1) may be unlocked using engaging/disengaging mechanism 510(1) when it is desirable to release tension in resistive element 110.

Figure 8:
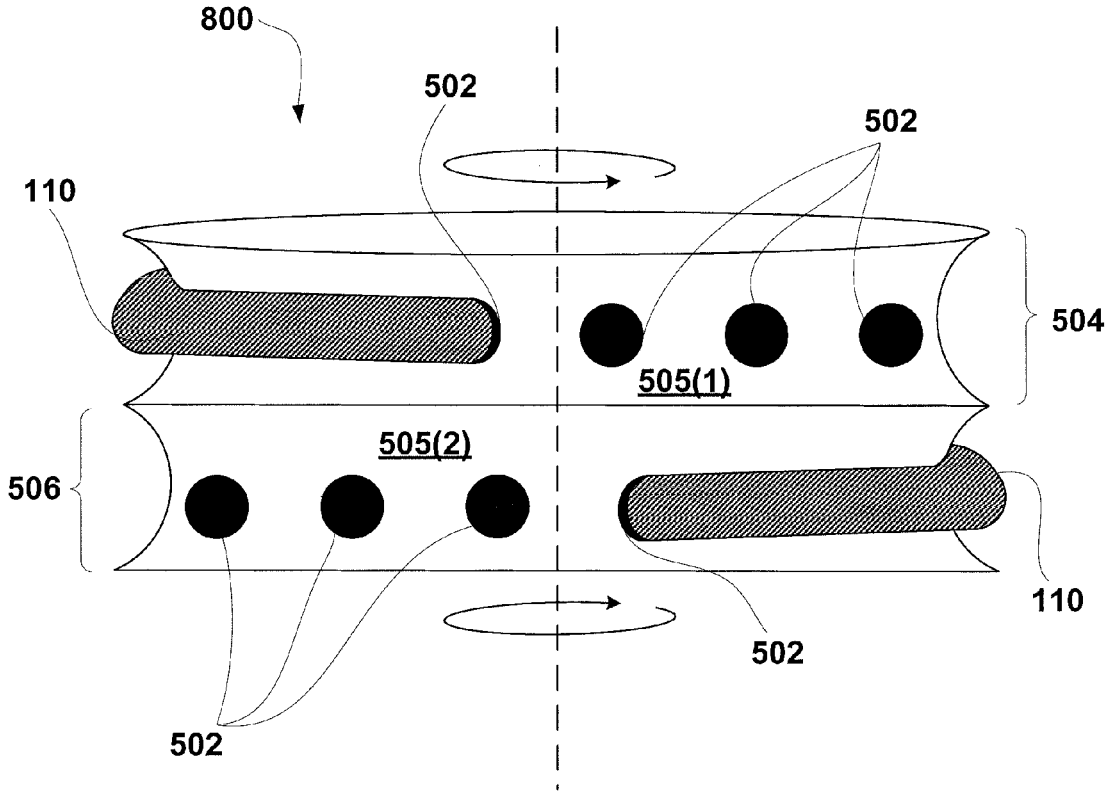
FIG. 8 shows a side perspective view of a spring loaded pulley according to one embodiment.
Figure 9:
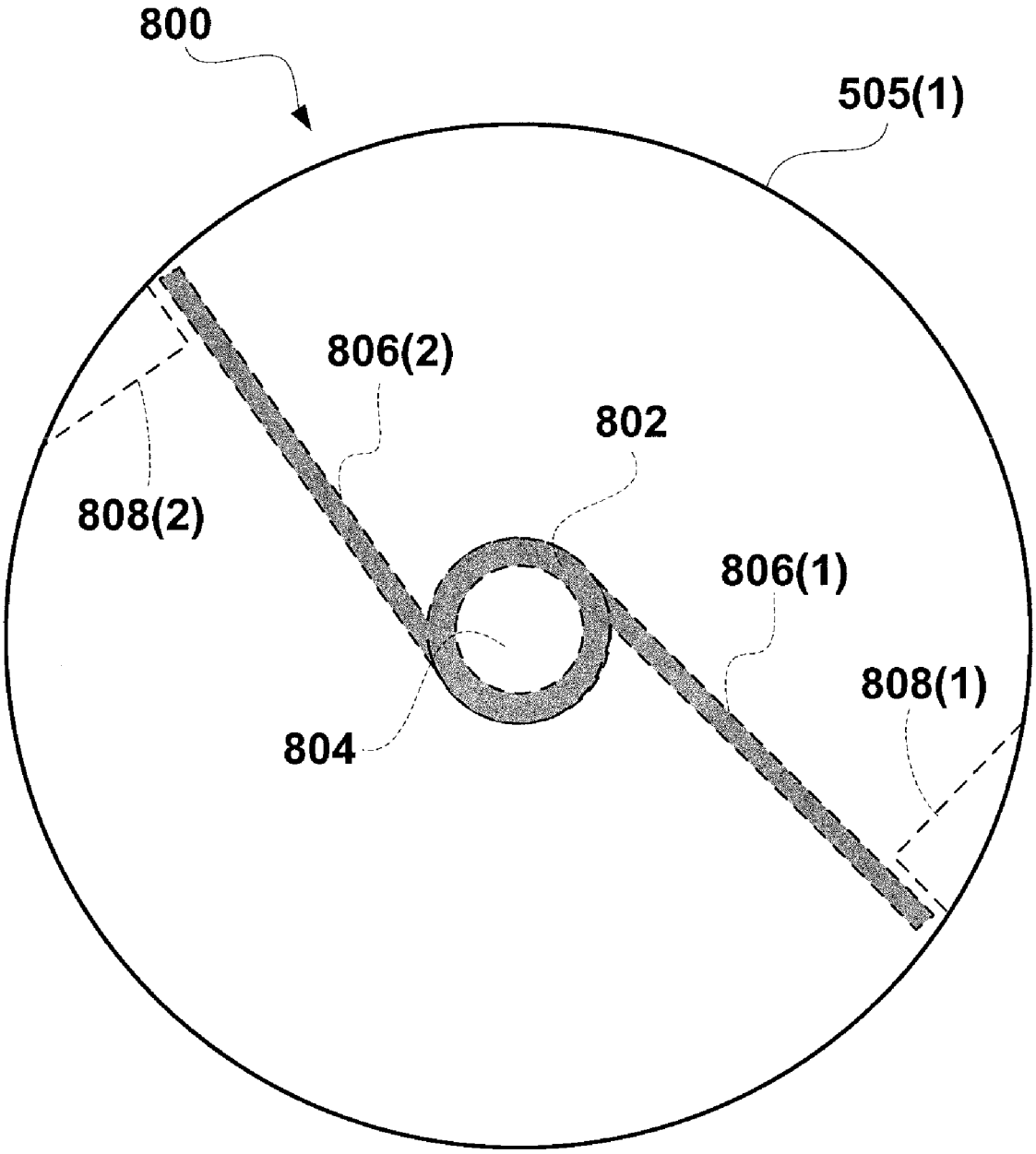
FIG. 9 shows a top plan view of the spring loaded pulley of FIG. 8.
Figure 10:
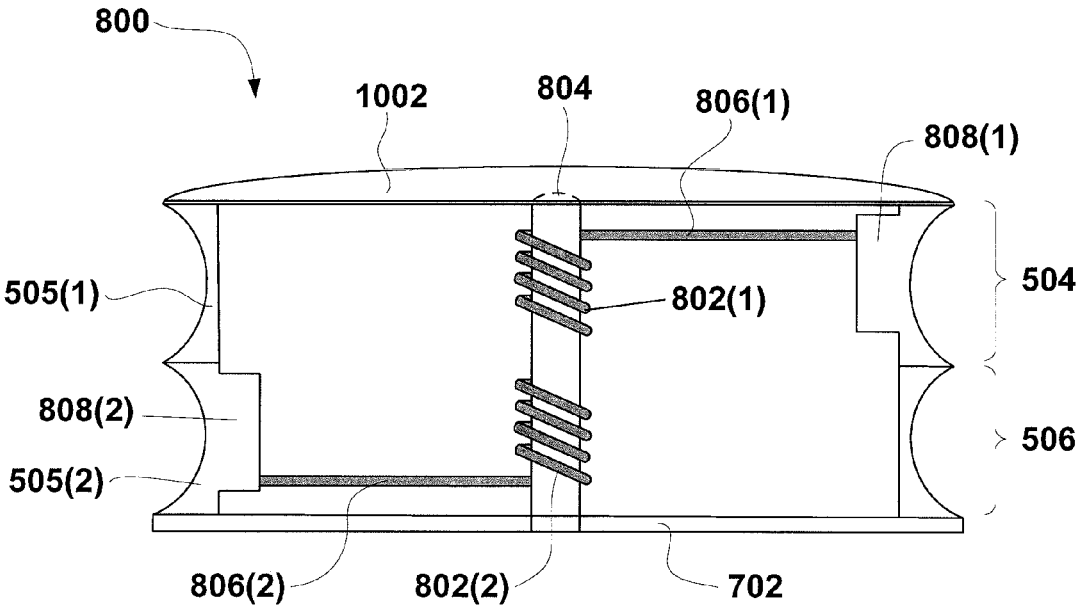
FIG. 10 shows a cross-sectional side view of the spring loaded pulley of FIGS. 8 and 9.

FIG. 8 shows a side perspective view of a spring loaded pulley 800. Spring loaded pulley 800 is shown as a dual pulley having external features, such as layers 504, 506, housing 505, and holes 502, similar to those described above with reference to ratchet pulley 500, FIGS. 5-7. FIG. 9 shows a top plan view of the spring loaded pulley 800 of FIG. 8. Torsion springs 802 are fixedly mounted on a spring mounting axle 804. Torsion springs 802 may, for example, be affixed to spring mounting axle 804 by an adhesive or by threading a portion of torsion spring 802 through mounting axle 804. A spring arm 806 of torsion spring 802 abuts an arm stop 808. FIG. 10 shows a cross-sectional side view of spring loaded pulley 800. Spring mounting axle 804 is fixedly attached to base 702, but does not touch top portion 1002 of layer 504. Force on arm stop 808(1) from spring arm 806(1) will cause housing 505(1), and any resistive element(s) 110 attached thereto, to rotate in a direction that releases spring tension unless a counter force is applied on resistive element 110.

The resistance of spring loaded pulley 800 may be manually set by twisting housing 505 in the direction of increasing spring tension. At the position of desired resistance, resistive element 110 may be anchored in an appropriate hole 502.

Alternatively, resistive element 110 may be anchored to spring loaded pulley 800 prior to manually setting the tension of pulley 800 and a distal end of resistive element 110 may be anchored to an adjustment device 202, for example a clam cleat, when the tension of spring loaded pulley 800 is sufficient.

Spring loaded pulley 800 is able to take-in and pay-out resistive element 110 as movement progresses. Therefore, spring loaded pulley 800 may be used with elastomeric resistive elements 110, as described above, or with resistive elements 110 that are non-stretching, static cords, belts, cables, fibers, chains or straps.

It will be appreciated that pulleys for use with the resistance garments described herein may have one, two or more layers (e.g., 504, 506), and that each layer may anchor one or more resistive elements 110.

Figure 11:
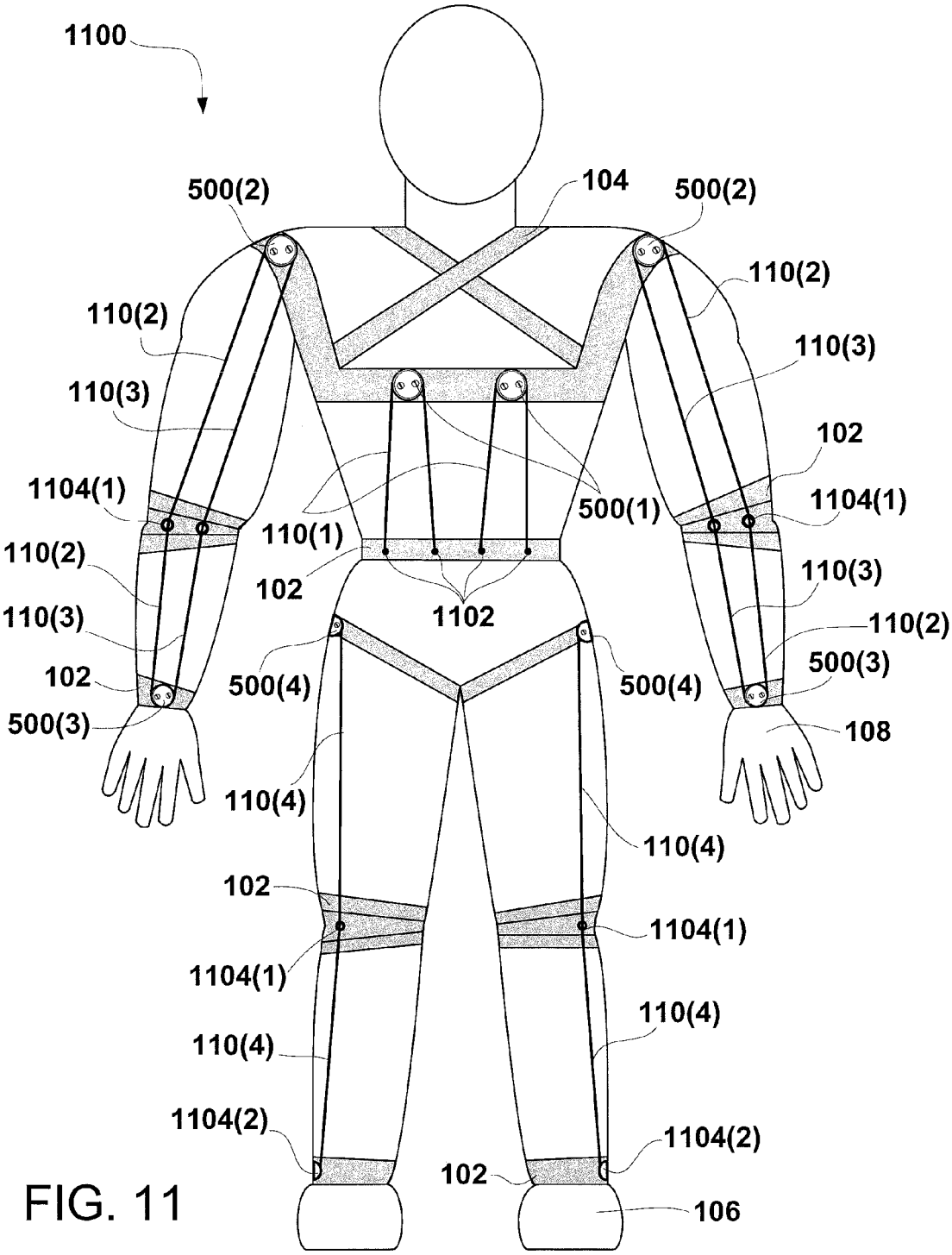
FIG. 11 shows a manually adjustable resistance garment utilizing a ratchet pulley system according to one embodiment.
Figure 12:
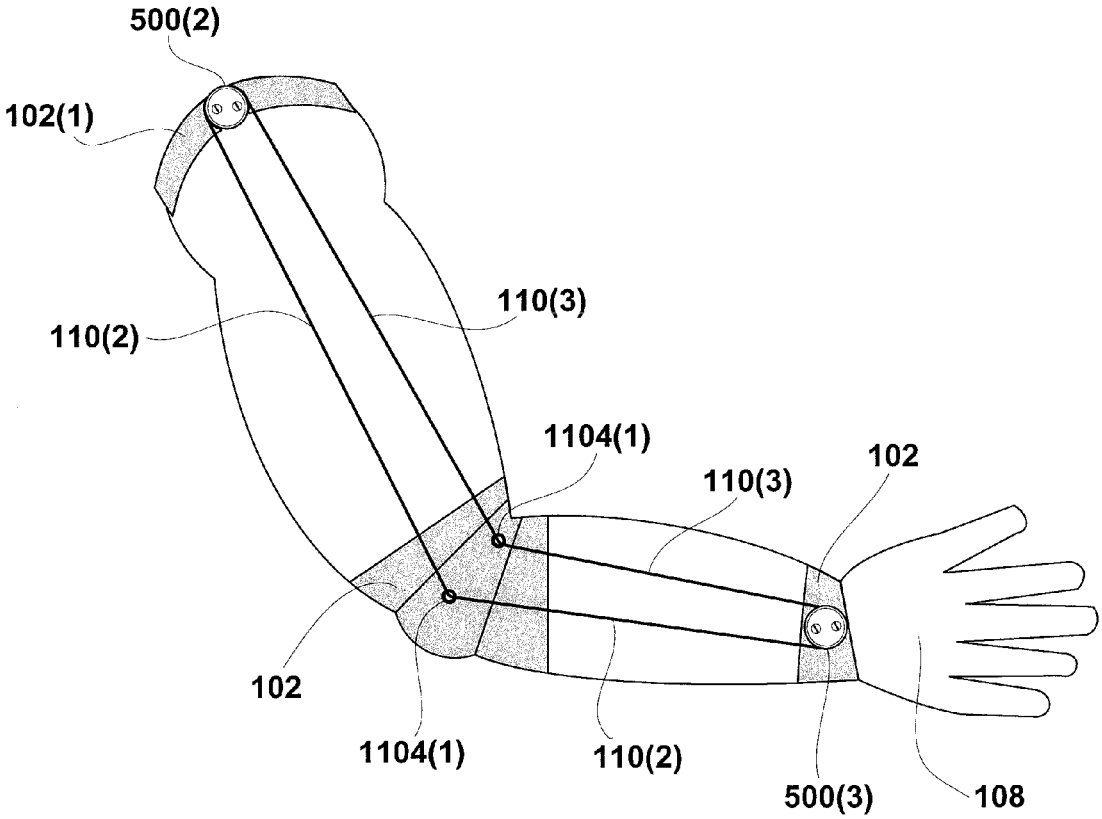
FIG. 12 shows an arm portion of the resistance garment of FIG. 11.
Figure 13:
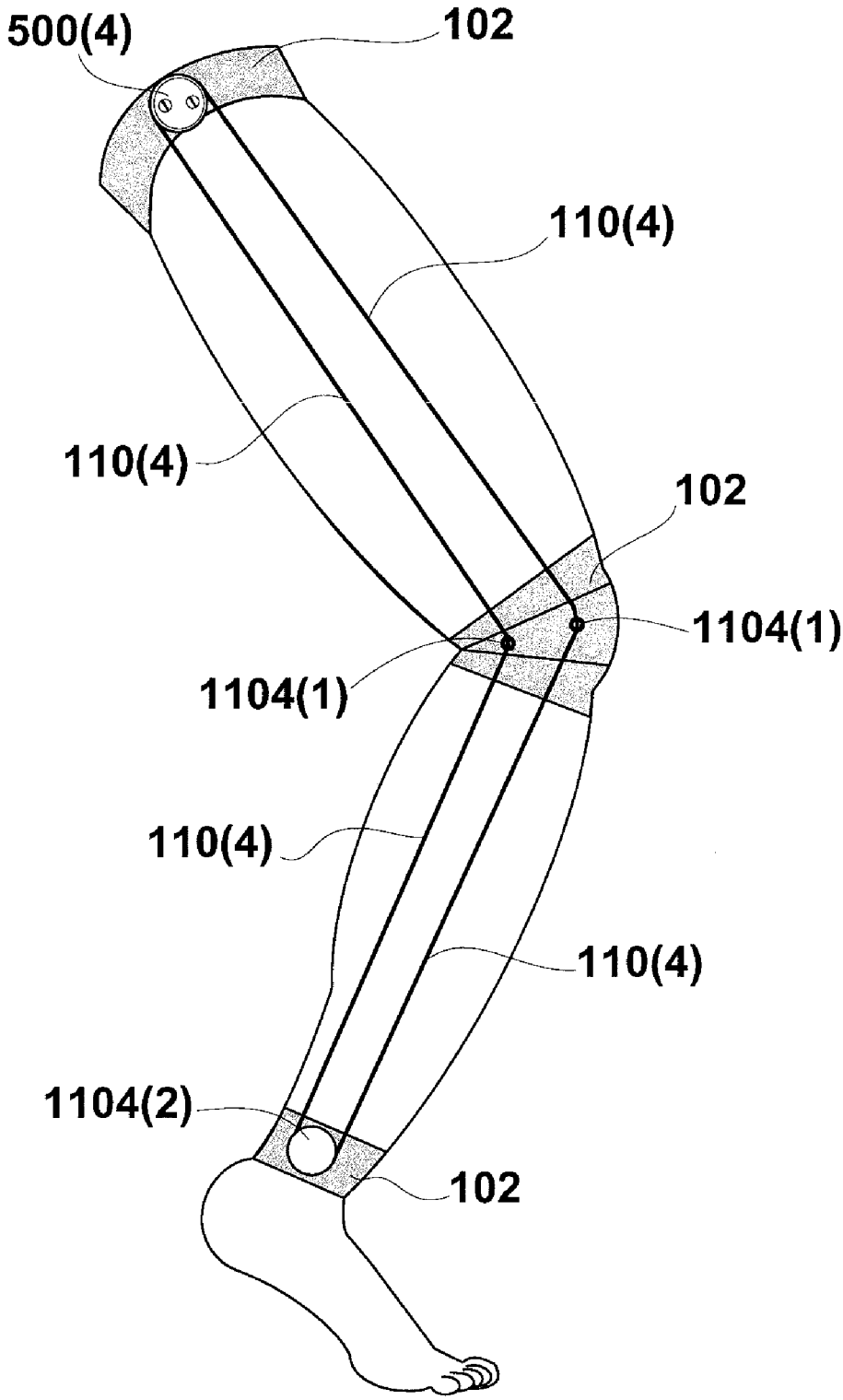
FIG. 13 shows a leg portion of the resistance garment of FIG. 11.

FIG. 11 shows a manually adjustable resistance garment 1100 utilizing a ratchet pulley system. In this embodiment, resistive elements 110 are routed in a linear manner. For example, resistive elements 110(1) are fixedly attached to anchor points 1102, e.g., a ring or post, and a ratchet pulley 500(1). In another example, shown in greater detail in FIG. 12, resistive elements 110(2) and 110(3) are linearly routed between two ratchet pulleys 500(2) and 500(3). Ring-shaped guides 1104(1) that are positioned on a cuff at a centrally located joint maintain or redirect the path of resistive elements 110(2), 110(3). In yet another example, shown in greater detail in FIG. 13, resistive element 110(4) originates at ratchet pulley 500(4), extends through ring-shaped guide 1104(1), wraps around circular guide 1104(2) and extends back through a second ring-shaped guide 1104(1) to ratchet pulley 500(4). Ratchet pulleys 500, anchor points 1102 and guides 1104 are disposed on cuffs 102 or harness 104.

Figure 14:
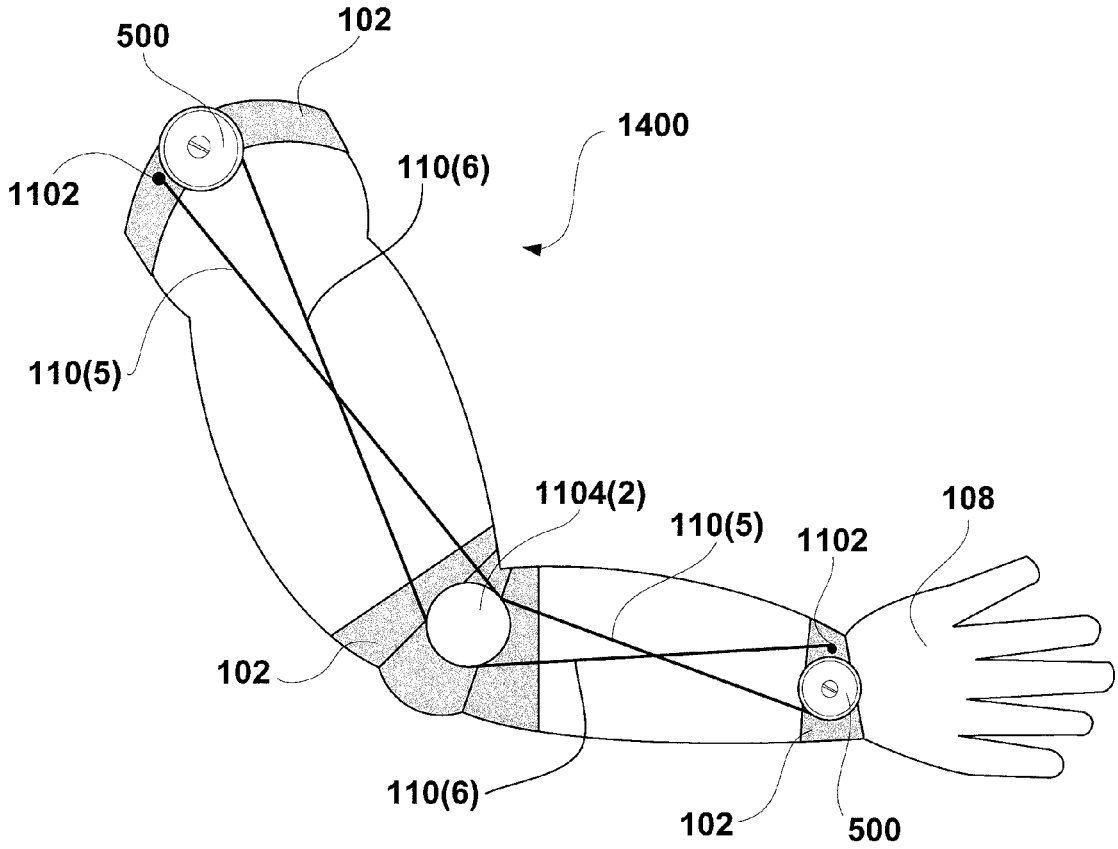
FIG. 14 shows an arm portion of a resistance garment according to one embodiment.

FIG. 14 shows another arm portion 1400 of a resistance garment. In this embodiment, ratchet pulleys 500 and anchor points 1102 are disposed on shoulder and wrist cuffs 102. Resistive element 110(5) or 110(6) is fixedly attached to an anchor point 1102, loops around guide 1104(2) on the wearer's elbow, and terminates at a ratchet pulley 500.

Figure 15:
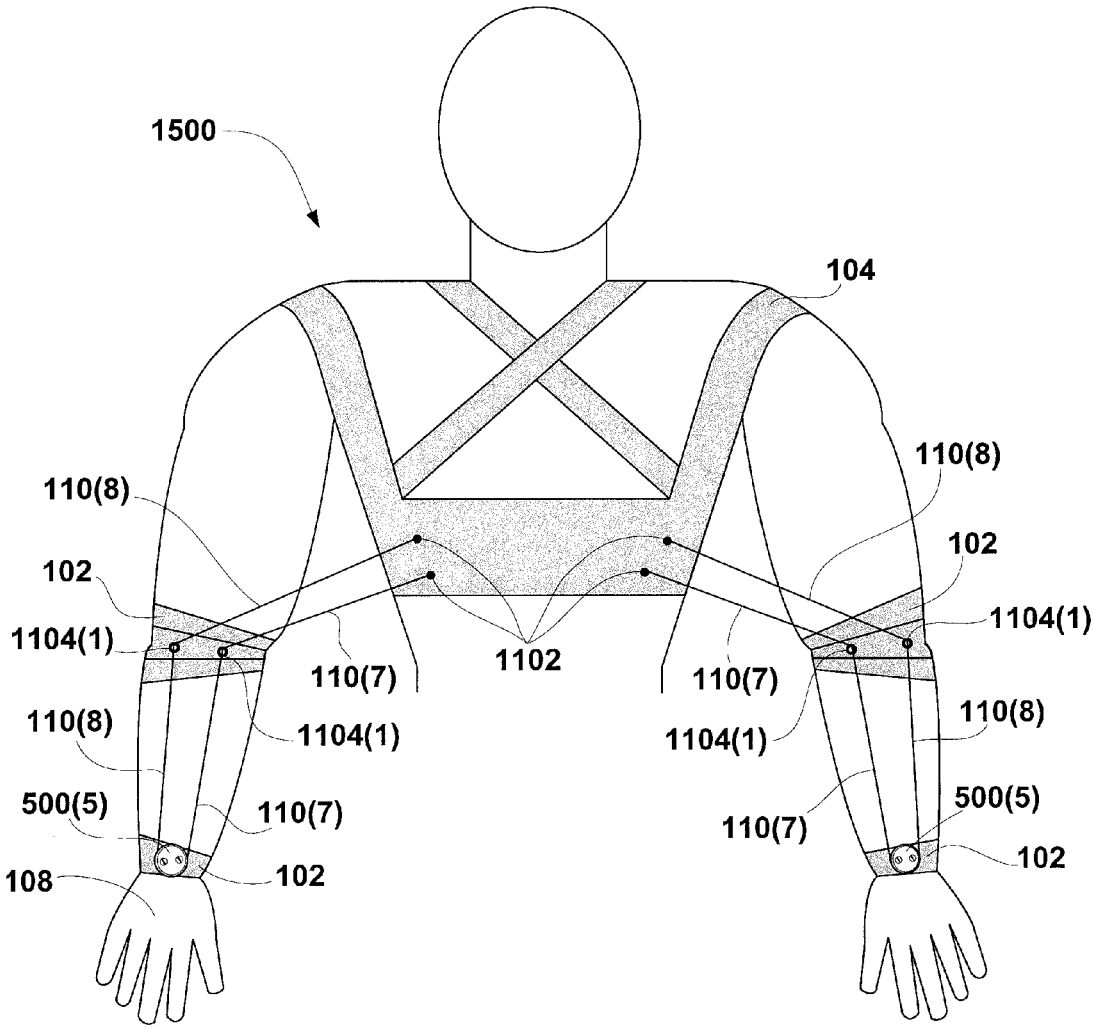
FIG. 15 shows an upper body portion of a resistance garment according to one embodiment.

FIG. 15 shows an upper body portion 1500 of a resistance garment utilizing a ratchet pulley system. In this embodiment, resistive elements 110(7) and 110(8) begin at anchor points 1102 and extend through ring-shaped guides 1104(1) to ratchet pulleys 500(5). The embodiment of FIG. 15 provides resistance when an arm is bent and/or abducted from the torso.

Figure 16:
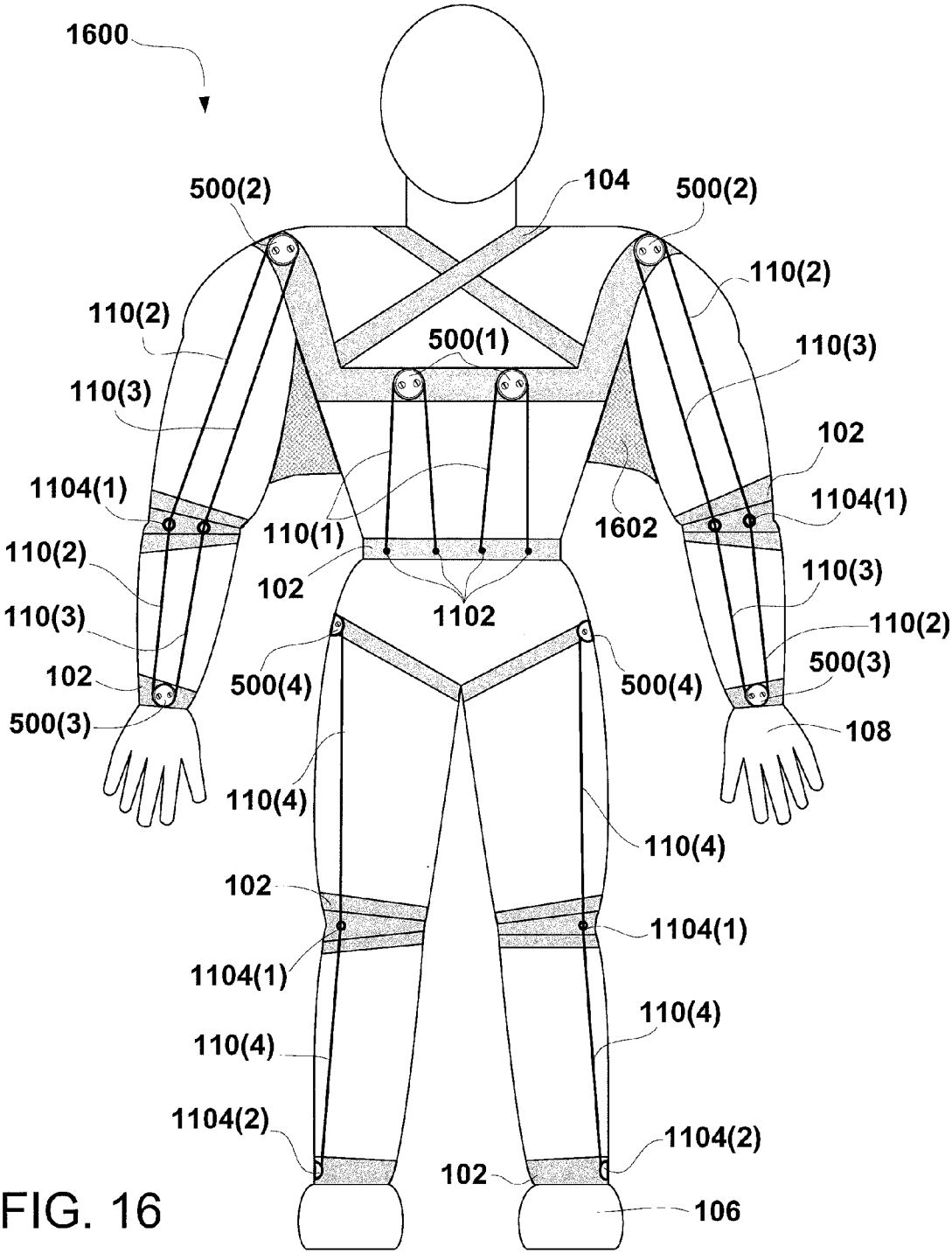
FIG. 16 shows the resistance garment of FIG. 11 including webbing according to one embodiment.

FIG. 16 shows a resistance garment 1600 including webbing 1602. The resistance garment shown is similar to the resistance garment shown in FIG. 11; however, webbing 1602 resists abduction of an arm from the torso.

Figure 17A:
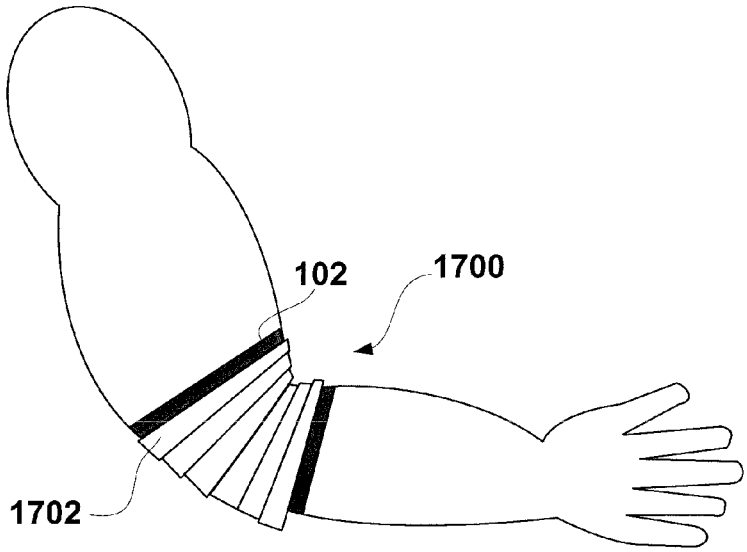
FIG. 17A and FIG. 17B show resistive plate devices, according to embodiments.
Figure 17B:
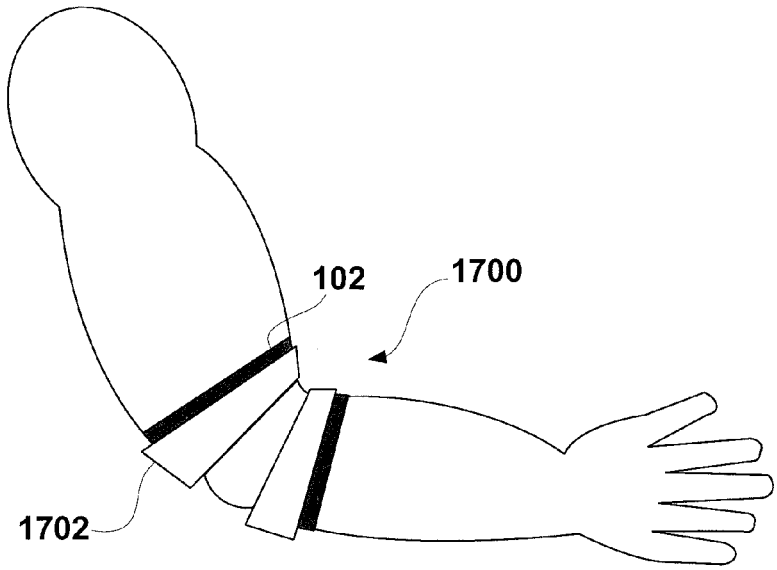

Another device that is contemplated for use with the resistance garments described herein is a resistive plate device. FIGS. 17A and 17B show exemplary resistive plate devices 1700, 1700' that may be worn on a joint, e.g., an elbow. Resistive plate devices 1700, 1700' contain baffles 1702 that are relatively stiff and may, for example, be made of plastic or metal. Each baffle 1702 is able to partially slide over or under a neighboring baffle, which allows the resistive plate devices 1700, 1700' to compress and expand. A cuff 102 may be worn under resistive plate devices 1700, 1700' to prevent friction with or pinching of the skin. Cuff 102 may be made of a compressive material, as described above, and may be fixedly attached to resistive plate devices 1700, 1700' in order to keep devices 1700, 1700' from becoming displaced. In some embodiments, it may be desirable for baffles 1702 to be disposed on only one portion of resistive plate devices 1700, 1700'. For example, cuff 102 may circumscribe a wearer's joint and baffles 1702 may be attached to only the front or back of cuff 102, to reduce production costs and/or to provide greater comfort to a user.

Figure 18A:
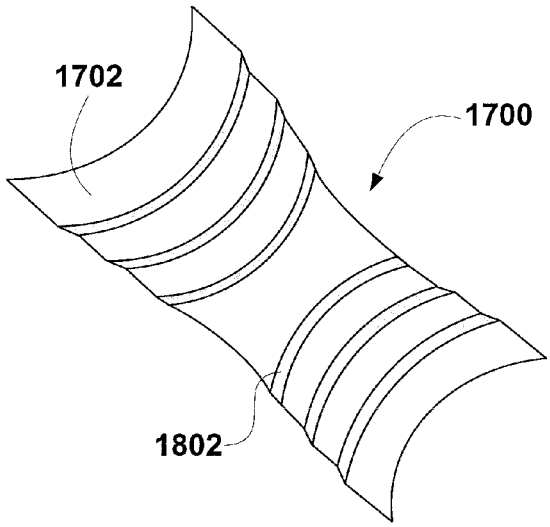
FIGS. 18A, 18B and 18C show cross-sectional views of resistive plate devices, according to embodiments.
Figure 18B:
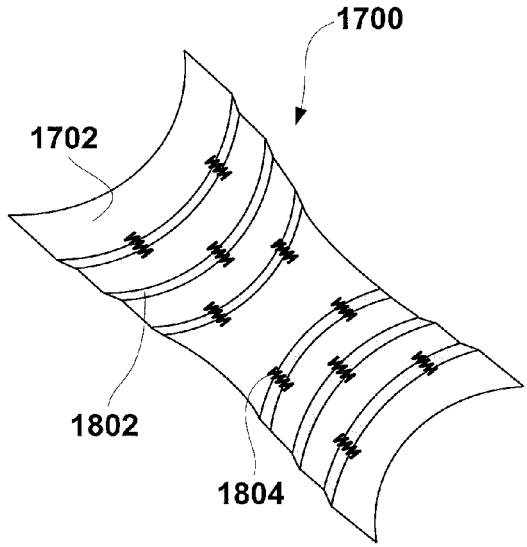
Figure 18C:
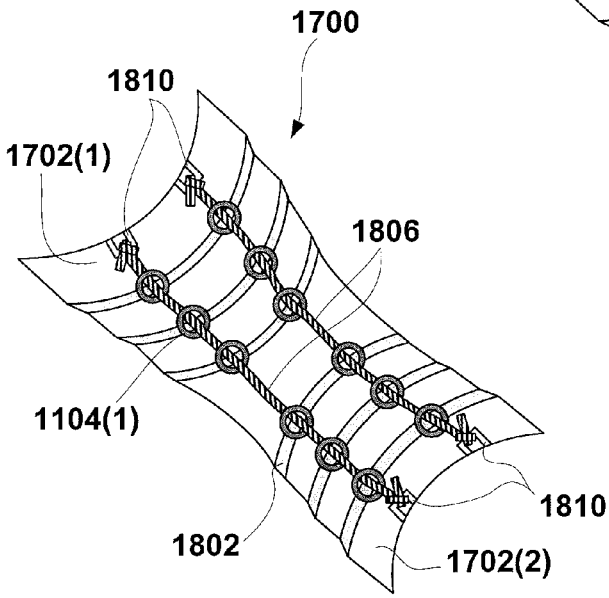

Mechanical friction may result from contact between neighboring baffles 1702 when they slide over and/or under one another. However, resistive plate devices 1700, 1700' may also contain mechanical elements that provide resistance. FIGS. 18A, 18B and 18C show such mechanical elements in longitudinal cross-sectional views of resistive plate devices 1700. In FIG. 18A, a flexible, rubberized material 1802 secures baffles 1702 to one another, and inhibits compression and extension of resistive plate device 1700. FIG. 18B shows the use of springs 1804 in addition to rubberized material 1802. In one example of fabrication, springs 1804 are welded to resistive plate device 1700. FIG. 18C shows a resistive plate device 1700 including one or more elastomeric lines 1806. Elastomeric lines 1806 may, for example, be secured to resistive plate device 1700 by a plurality of ring-shaped guides 1104(1) and by tying the ends of elastomeric lines 1806 to eyelets 1810, which form part of terminal baffles 1702(1) and 1702(2).

Figure 19:
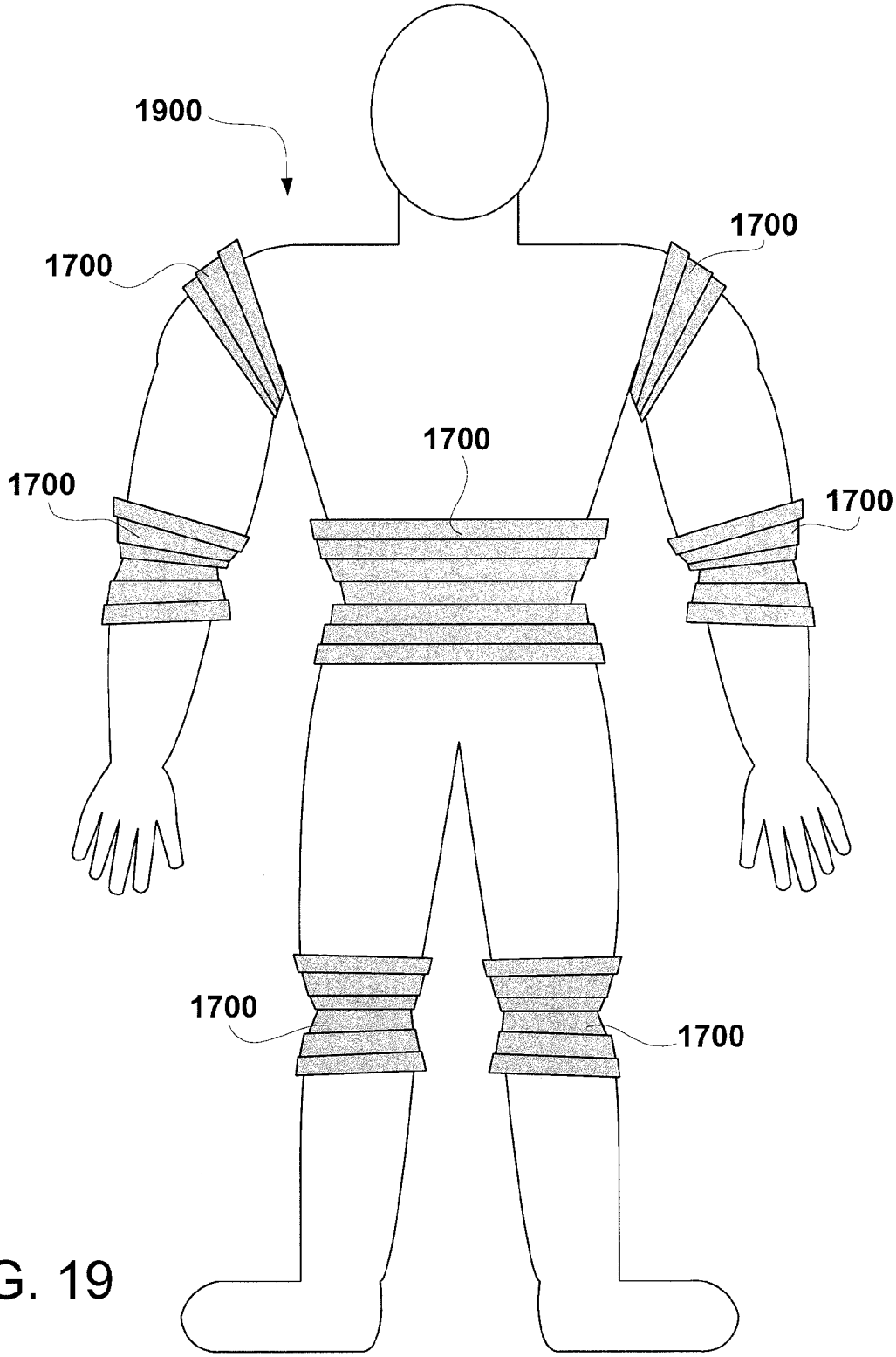
FIG. 19 shows a resistance garment utilizing resistive plate devices according to one embodiment.

FIG. 19 shows a resistance garment 1900 utilizing resistive plate devices 1700. As shown, resistive plate devices 1700 may be worn at various positions on the body including shoulder, elbow, waist, and knee positions. Resistive plate devices 1700 may be applied individually, or a plurality of devices may form part of a garment, e.g., a one-piece suit, pants, or a shirt.

Figure 20:
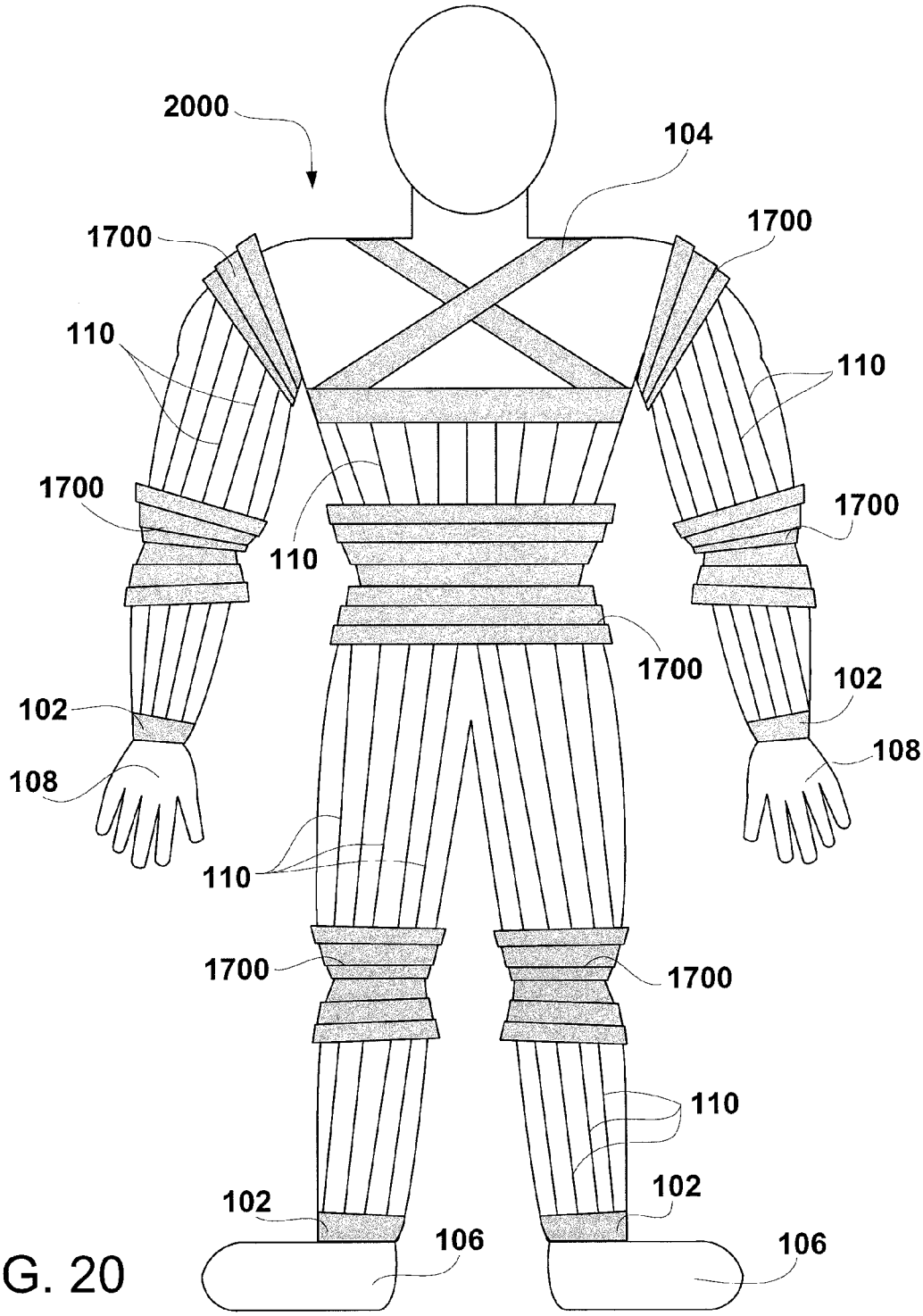
FIG. 20 shows a resistance garment utilizing resistive plate devices and resistive elements according to one embodiment.

FIG. 20 shows a resistance garment 2000 utilizing resistive plate devices 1700 and resistive elements 110. It will be appreciated that resistance garment 2000 may also include adjustment devices as described herein, e.g., clam cleats, ratchet pulleys, spring loaded pulleys, automated resistance devices and automated ratchet pulleys, and that such adjustment devices may be mounted on resistive plate devices 1700.

Figure 21:
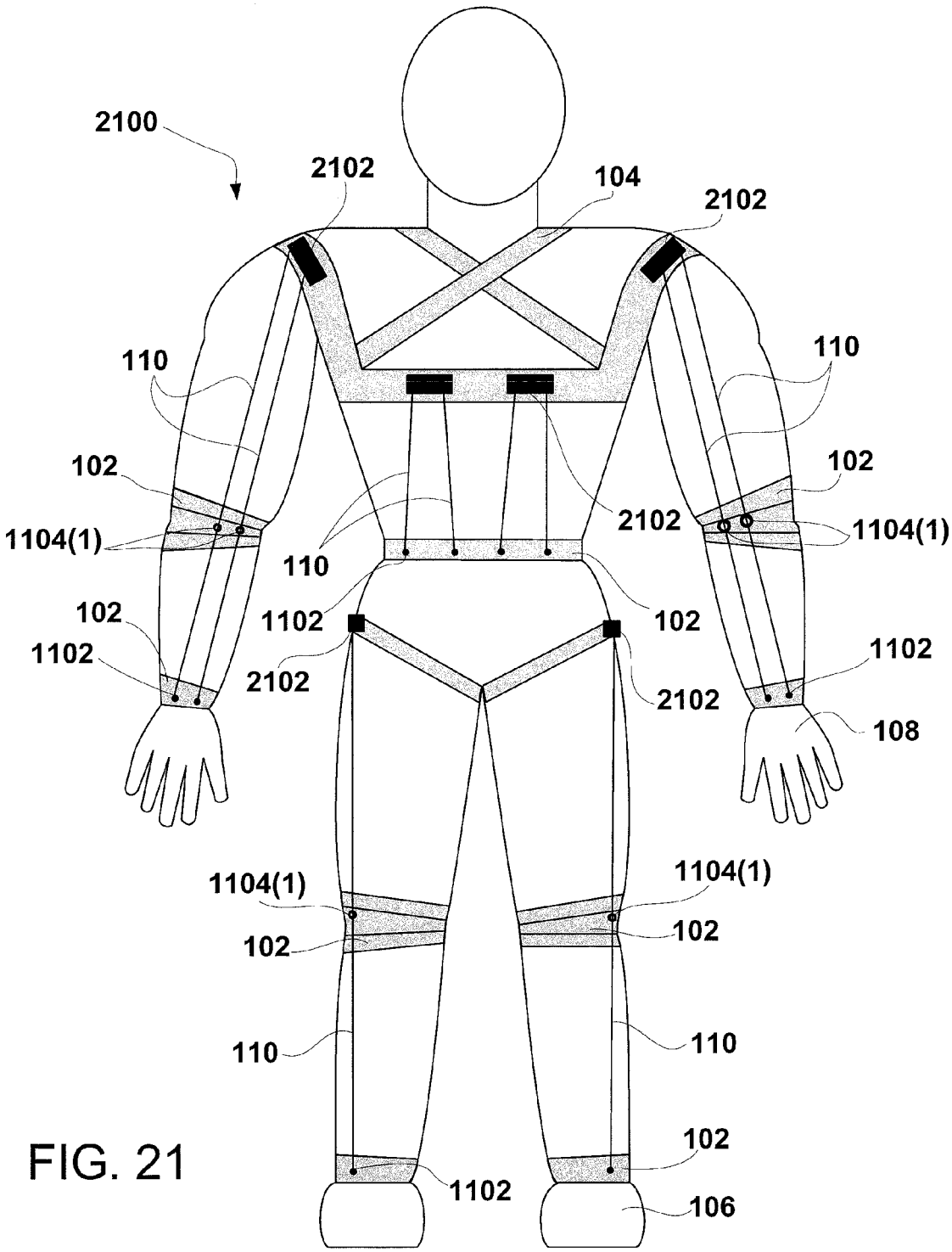
FIG. 21 shows an automated resistance garment according to one embodiment.
Figure 22:
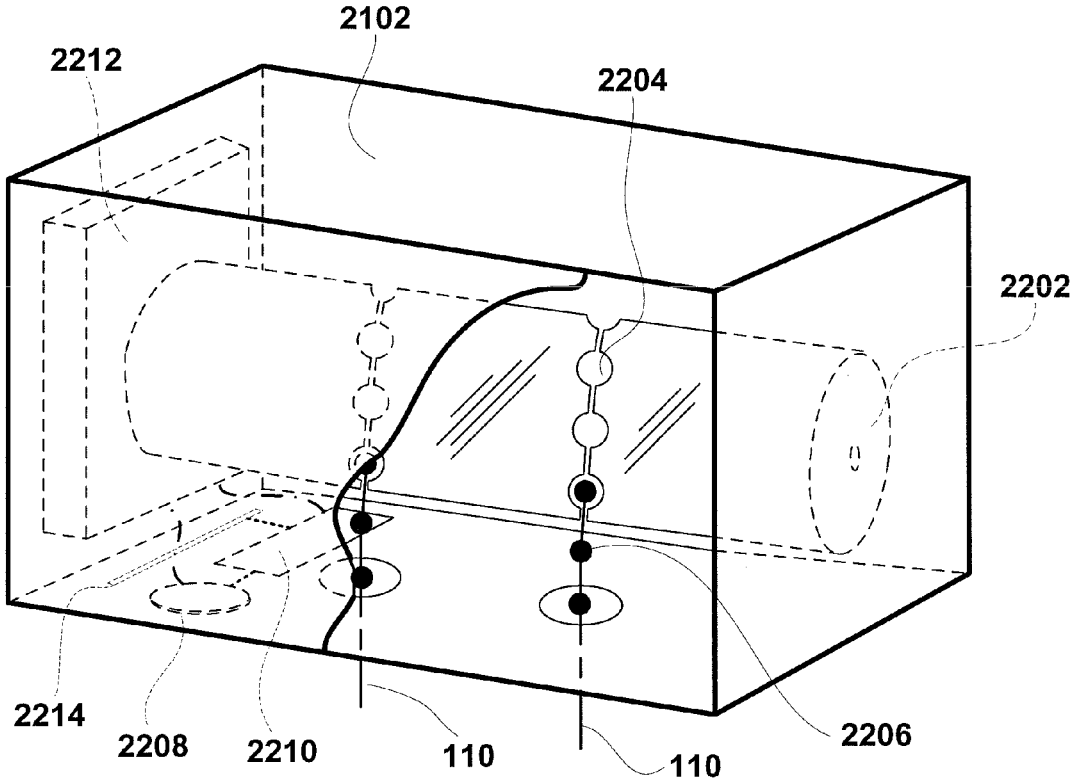
FIG. 22 shows a partial cut-away view of an automated resistance device according to one embodiment.

FIG. 21 shows an automated resistance garment 2100. Resistance garment 2100 includes automated resistance devices 2102 that apply or release tension according to a user input, or a learned pattern of resistance. FIG. 22 shows a partial cut-away view of automated resistance device 2102. Automated resistance device 2102 contains a battery 2208, or other power supply, for powering a motor 2212 that turns a dowel 2202. Dowel 2202 contains slots 2204 that receive balls 2206 from an end of resistive element 110. Battery 2208 also provides power to circuitry 2210, which provides instructions to motor 2212. Further, circuitry 2210 may communicate with other automated resistance devices 2102 by wireless signals transmitted and/or received by an antennae 2214. For example, automated resistance devices 2102 may receive program instructions and timing synchronization from a remote device or from a master automated resistance device 2102. A remote device or master automated resistance device has a user input for receiving program instructions. For example, program instructions may simulate a hill workout while a person runs on a flat surface, or the program may be used in rehabilitation to perform range of motion exercises.

Automated resistance device 2102 may also measure the load on motor 2212. For example, circuitry 2210 may operate to keep the load on motor 2212 constant. Signals containing information about the load and motor compensation pattern may be sent by antennae 2214 to a central processing unit that evaluates and learns the resistance patterns of a person wearing a resistance garment. The data may then be used to customize a resistance training program for an individual wearing an automated resistance garment. This type of evaluation and customization are particularly useful for activities that involve repetitive motion, e.g., running, cycling, cross-country skiing.

Figure 23:
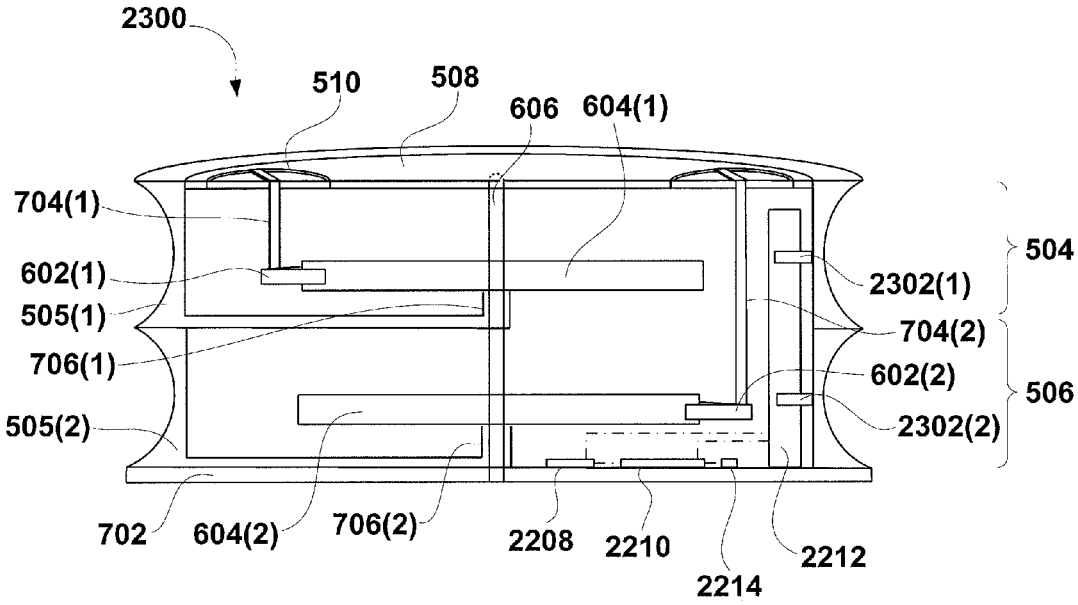
FIG. 23 shows a cross-sectional side view of an automated ratchet pulley according to one embodiment.

FIG. 23 shows a cross-sectional side view of an automated ratchet pulley 2300. In addition to those elements described with reference to FIG. 7, automated ratchet pulley 2300 contains a battery 2208, circuitry 2210, an antennae 2214 and a motor 2212, which operate as described with reference to FIG. 22. Motor 2212 is mounted to stationary base 702 and contains rollers 2302 that interface with housing 505(1) and 505(2) of layers 504 and 506, respectively. Rollers 2302 may be smooth rubber rollers or toothed rollers that interface with a grooved surface on the interior of housing 505. For example, movement of roller 2302(1) compels layer 504 to rotate in an opposing direction.

Figure 24:
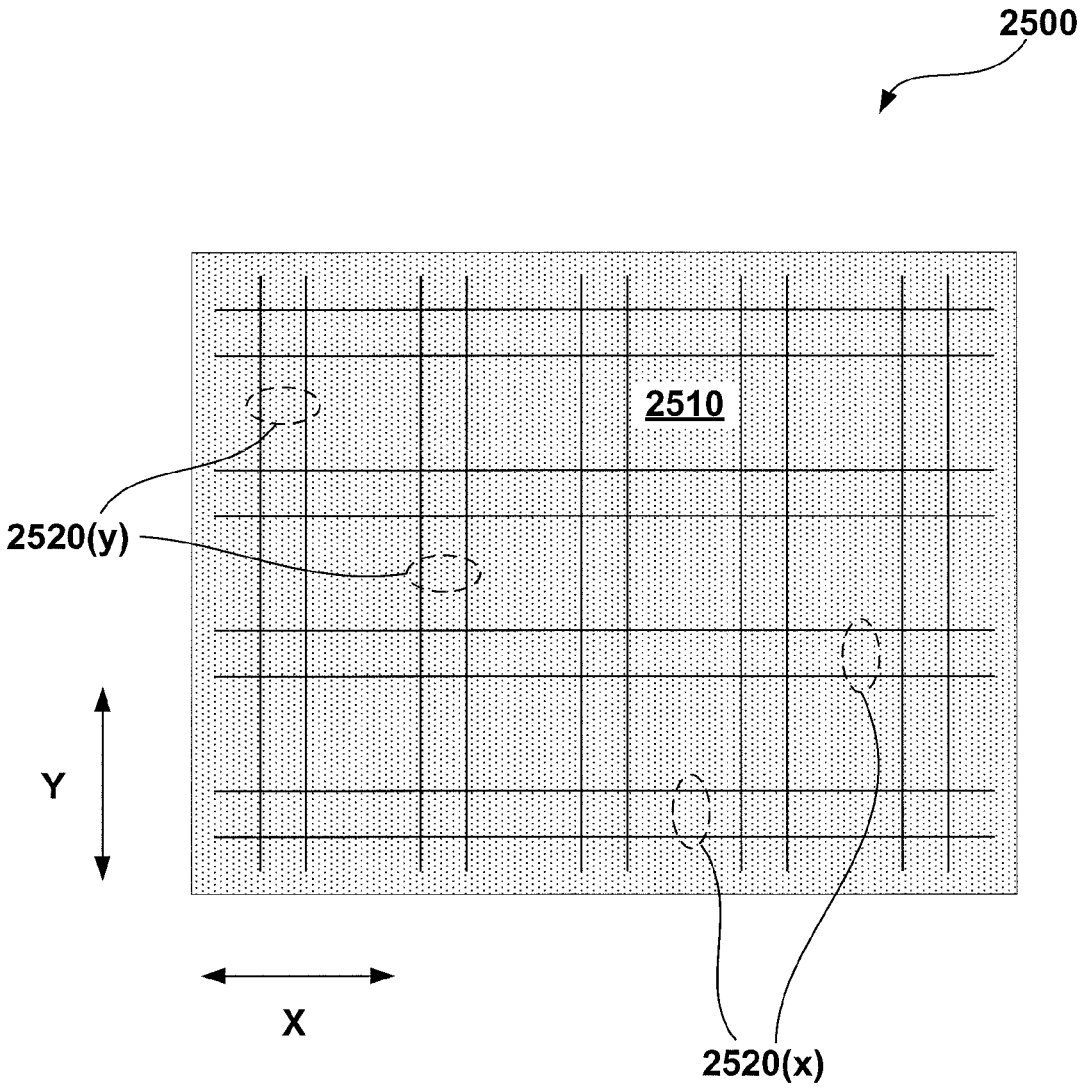
FIG. 24 schematically illustrates an active material that includes a backing fabric and length-adjusting elements, in accord with an embodiment.

FIG. 24 schematically illustrates an active material 2500 that includes a backing fabric 2510 and length-adjusting elements 2520. Each length-adjusting element 2520 is shown schematically in FIG. 24 as a pair of lines (although certain length-adjusting elements may involve more or fewer than a pair of filaments, see FIG. 33 and FIG. 34). Length-adjusting elements 2520($x$) adjust a dimension of active material 2500 in the X direction, and length-adjusting elements 2520($y$) adjust a dimension of active material 2500 in the Y direction; operation of length-adjusting elements 2520 is described further below. The term "backing fabric" is utilized herein to differentiate a structural component of an active material from the length adjusting device(s) therein, power distribution and control features, etc., but materials other than simple fabrics may be utilized as backing fabrics. Accordingly, backing fabric 2510 may include elastomeric materials (e.g., spandex, rubber, latex, silicones) or nonelastomeric materials (fabric, metal foils or meshes, etc.). Similarly, although fabrics will be shown in certain drawings as having a standard rectilinear weave (e.g., warp and weft), fabrics or other substances that are substantially in sheet form with fibers oriented differently, oriented omnidirectionally, or without fibers are also contemplated for use as backing fabrics, and such term shall encompass all such substances.

Figure 25:
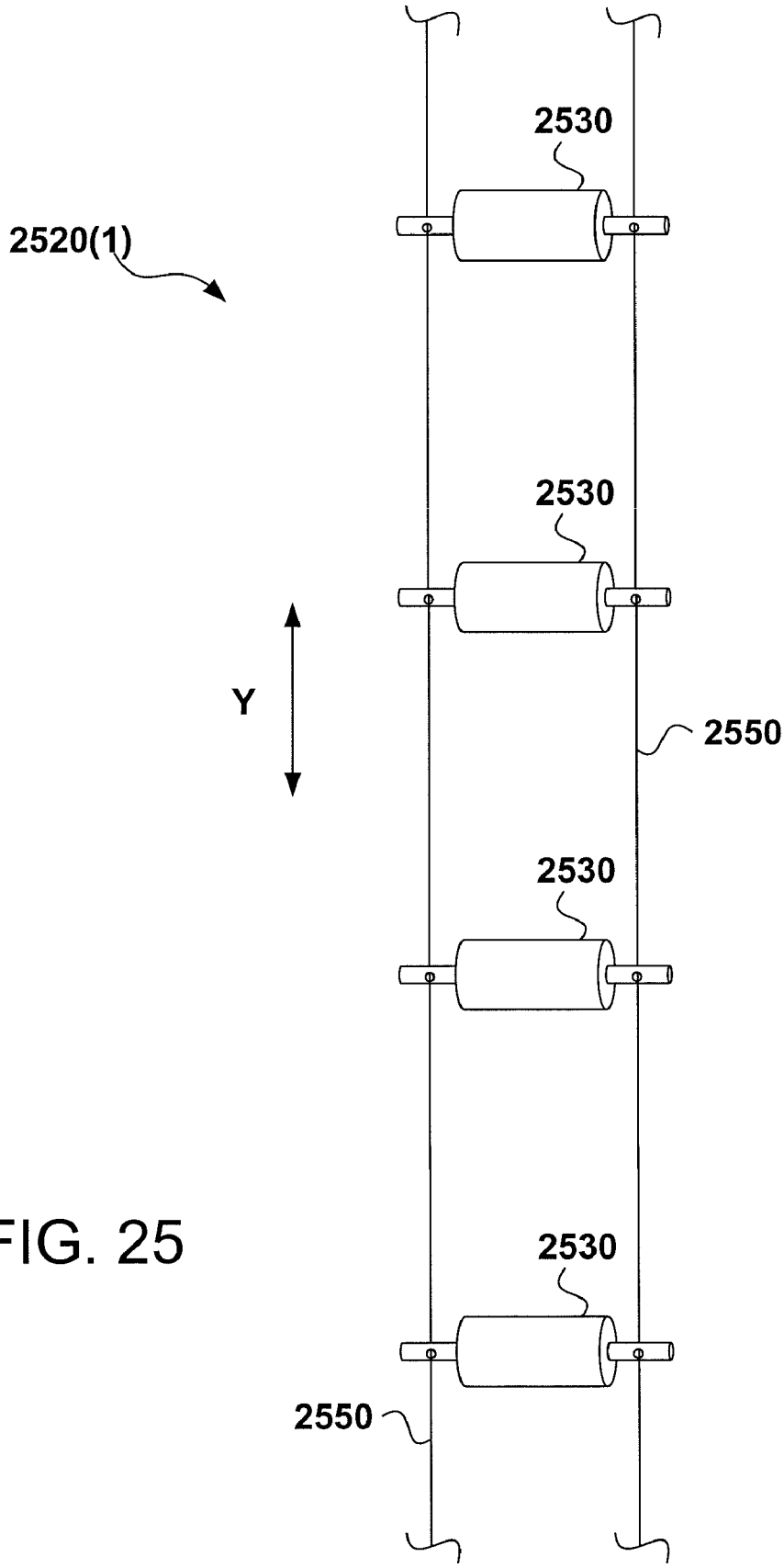
FIG. 25 shows detail of one length-adjusting element as shown in FIG. 24.
Figure 29:
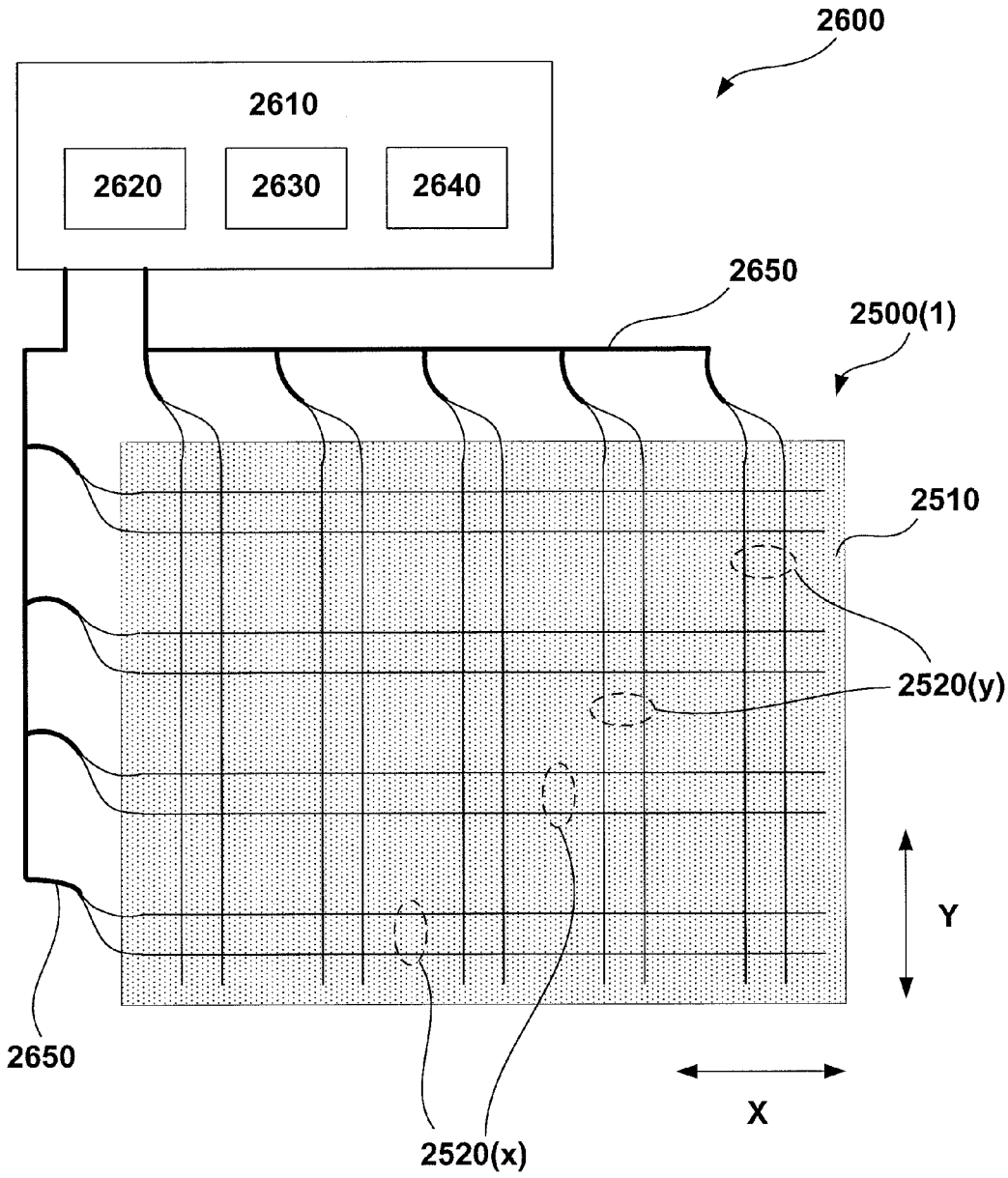
FIG. 29 schematically illustrates an active material application that utilizes an active material, in accord with an embodiment.

FIG. 25 shows detail of one length-adjusting element 2520(1) as shown in FIG. 24. Element 2520(1) resembles a "ladder" in organization, with filaments 2550 positioned as if "uprights" of the "ladder" and motors 2530 positioned as if "rungs" of the "ladder." Motors 2530 provide a means for length-adjusting element 2520(1) to adjust a length of filaments 2550 and, accordingly, a length of active material 2500. It should be clear that in FIG. 24, length-adjusting elements 2520(*x*) and 2520(*y*) may operate in the same fashion but are oriented differently within material 2500 and are controlled independently of one another; length-adjusting elements 2520(*x*) and 2520(*y*) therefore provide means for adjusting a length of active material 2500 independently in the X and Y directions shown in FIG. 24. Also, in this context "length" of filaments 2550 refers herein to an overall, end-to-end effective length of such filaments (e.g., a distance between anchored ends of such filaments, as shown in FIG. 29), notwithstanding the fact that a portion of each filament may be wound about one or more shafts and/or spooling devices.

Figure 26:
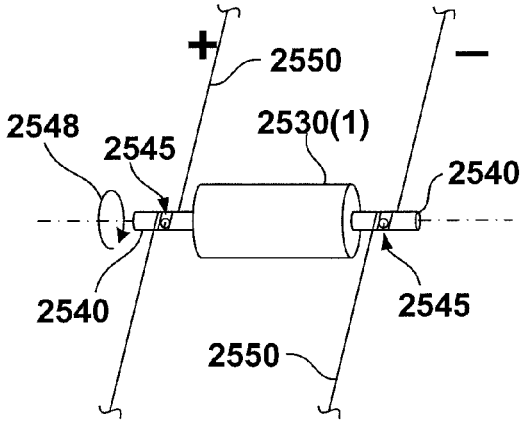
FIG. 26 shows a motor and exemplary connections with filaments in further detail, in accord with an embodiment.

FIG. 26 shows a single motor 2530(1) and exemplary connections with filaments 2550 in further detail. Motor 2530(1) may be, for example, a micromotor or nanomotor; such motors are presently available, for example, from MicroMo Electronics of Clearwater, Fla. and from Namiki Precision Jewel Co. of Japan, and smaller motors in development have been widely reported in literature pertaining to MEMS (micro electro-mechanical systems). In the embodiment shown in FIG. 26, filaments 2550 are conductive filaments such as conductive polymers or metal wires. Each motor 2530(1) has a shaft 2540 that extends through a center of motor 2530(1); each end of shaft 2540 forms a hole 2545 through which filament 2550 is threaded. It is understood that shaft 2540 with hole 2545 can be thought of as a spooling element. Other spooling elements contemplated herein may also include spools and/or reels driven by the ends of shaft 2540.

Applying a voltage differential to opposing ends of shaft 2540 (as indicated by the + and − next to filaments 2550) causes shaft 2540 to rotate (for example in the direction indicated by arrow 2548) which in turn "reels in" filaments 2550 onto shaft 2540, shortening a net length of filaments 2550.

Referring back to FIG. 25, it can be seen that when a voltage differential exists across filaments 2550, each motor 2530 reels in portions of both of the associated filaments 2550 in response. Accordingly, when the voltage differential is reversed, shafts 2540 of each motor 2530 will rotate in the opposite direction of arrow 2548 (FIG. 26), spooling out filaments 2550 and lengthening length-adjusting elements 2520. Operation of all of motors 2530 in this parallel manner quickly adjusts a net length of length-adjusting elements 2520. Referring back to FIG. 24, operating several such length-adjusting elements 2520 in this manner adjusts a corresponding dimension of active material 2500; either or both of length-adjusting elements 2520(*x*) and 2520(*y*) can be operated in this manner to independently adjust either the X or Y dimension of material 2500 accordingly.

Figure 27:
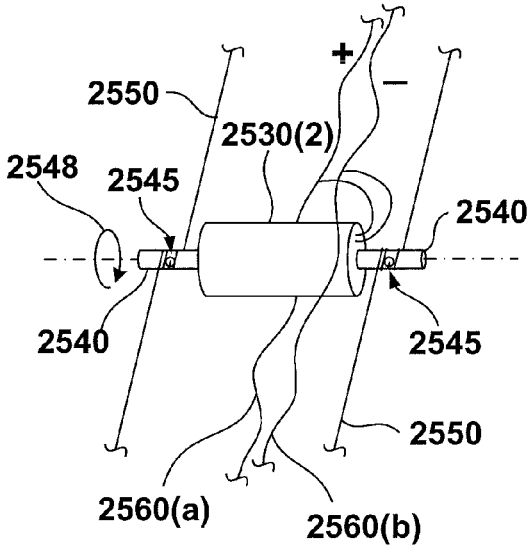
FIG. 27 illustrates a second motor type that connects with wires instead of making electrical connections through a shaft and filaments, in accord with an embodiment.

FIG. 27 illustrates a second motor type 2530(2) that connects with wires 2560(*a*) and 2560(*b*) instead of making electrical connections through shaft 2540 and filaments 2550. Motor 2530(2) reels in and spools out filaments 2550 in the same manner as motor 2530(1) but is powered through wires 2560(*a*) and 2560(*b*). However, use of motor 2530(2) does not require that filaments 2550 be conductive, such that materials such as monofilament polymer line, glass, Kevlar or carbon fibers may be utilized for filaments 2550.

Figure 28:
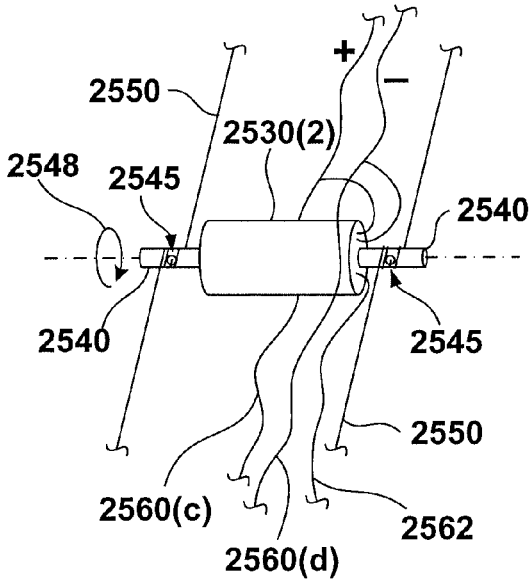
FIG. 28 illustrates a third motor type that connects with wires for power connections and also connects with a control wire, in accord with an embodiment.

FIG. 28 illustrates a third motor type 2530(3) that connects with wires 2560(*c*) and 2560(*d*) for power connections, and connects with a control wire 2562. Motor 2530(3) reels in and spools out filaments 2550 in the same manner as motor 2530(1) and 2530(2) but is powered through wires 2560(*c*) and 2560(*d*), and is controlled through wire 2562. For example, a voltage of wire 2562 (referenced to a voltage of either wire 2560(*c*) or 2560(*d*)) may be interpreted by motor 2530(3) as a signal for motor 2530(3) to run forward, in reverse, or stop. Motor 2530(3) does not require that filaments 2550 be conductive, such that materials such as monofilament polymer line, glass, Kevlar or carbon fibers may be utilized for filaments 2550. Furthermore, since control wire 2562 essentially "gates" operation of motor 2530(3), wires 2560(*c*) and 2560(*d*) may provide continuous power connections (e.g., power and ground) to motor 2530(3). The ability to leave wires 2560(*c*) and 2560(*d*) "on" continuously may facilitate implementation of dedicated layers of an active material as power and ground layers, as described further below.

It will be appreciated that size, number and positioning of motors 2530 along length-adjusting elements 2520, number and positioning of length-adjusting elements 2520, and strength of filaments 2550 may be chosen according to an intended use of material 2500. Furthermore, length-adjusting elements 2520 do not have to be relatively oriented at right angles within an active material 2500; other arrangements are possible, including use of three or more orientations within material 2500 instead of the two orientations shown in FIG. 24.

Given an appropriate size and density of motors 2530 and length-adjusting elements 2520 (e.g., a number of motors 2530 and length-adjusting elements 2520 per square inch or square foot of material 2500), material 2500 can function much like a muscle, that is, be able to contract and relax in accordance with requirements of an application, with strength, elasticity and texture appropriate for the application. Active material 2500 may be utilized, for example, in applications such as airfoil surfaces, boats, tires, clothes, casts and other rehabilitation devices, robots, shoes and buildings. For example, material 2500 may be utilized as part or all of a sail, and may be controlled by a sailor to tighten under certain conditions and loosen under other conditions according to sailing conditions such as wind direction and strength. Material 2500 may be utilized within a tire and may be controlled by a driver of a vehicle (or a computer of the vehicle) to tighten in certain locations within the tire under certain conditions to improve traction relative to a tire that does not utilize material 2500. In an airfoil, sail or tire application, motors 2530 may be micromotors on the order of one to ten millimeters in diameter and 5 to 50 millimeters in length, and filaments 2550 may be mechanically tough filaments such as steel or carbon fiber. In another embodiment, material 2500 may be utilized within clothes as an alternative to tailoring. That is, material 2500 may be initially set up (e.g., at a store) to precisely fit a wearer of the clothes without cutting and stitching that would otherwise be required for a precise fit; furthermore, material 2500 could be adjusted (by the wearer, or upon return to a retail outlet having an appropriate control unit, see for example FIG. 29) to account for changes in size of the wearer as a result of weight gain or loss, growth of a child wearer, or pregnancy. Material 2500 may be particularly useful in clothing intended to be rented, so that the clothing can be tailored to fit different wearers at different times. In clothing applications, motors 2530 may be nanomotors that are less than one millimeter in diameter and less than four millimeters in length (for example, approximately the diameter of a human hair), with tens or hundreds of motors 2530 per square inch of active material such that the motors do not noticeably alter a texture of material 2500.

It should be clear from the above discussion that upon reading and appreciating the present disclosure, one skilled in the art will understand that choice of a motor for an active material application is a matter of matching size, torque and/or other mechanical specifications of the motor to the application. The disclosure herein should be understood to teach use of length adjusting devices in applications other than those explicitly listed. In particular it is contemplated that smaller motors will continue to be developed and commercialized, enabling applications within the scope of this disclosure that are not feasible with the motors developed to date.

Figure 30:
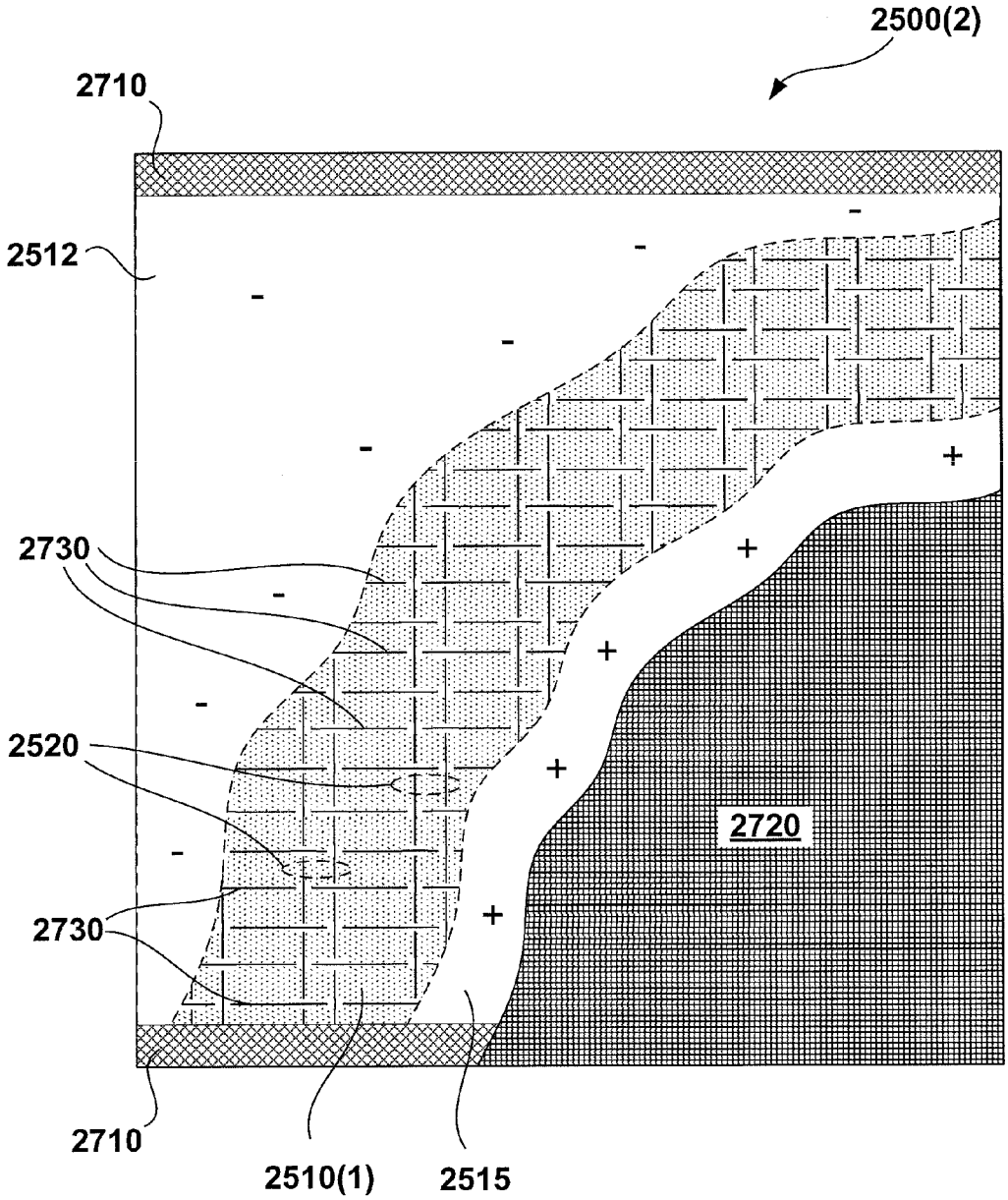
FIG. 30 is a cutaway schematic drawing of an active material showing integration of length-adjusting elements and power supply layers within the material, in accord with an embodiment.

FIG. 29 schematically illustrates an active material application 2600 that utilizes active material 2500. Application 2600 includes a control unit 2610 that further includes a power source 2620, a controller 2630 and an input/output device 2640. Power source 2620 may be a battery or a connection to an external power source (e.g., household or industrial AC power, or a DC source such as a vehicle power system). Input/output device 2640 may be for example buttons, switches or a keypad for human use, so that a user of application 2600 can direct controller 2630. Alternatively, input/output device 2640 may be an electronic port that receives information or commands from a computer, a network or sensors; when input/output device 2640 is an electronic port it may be a connection for wiring and/or optical fiber but may also be a wireless receiver (e.g., a radio frequency or infrared receiver). In response to input from device 2640, controller 2630 selectively transmits power from power source 2620 into wiring 2650, which in turn powers each of length-adjusting elements 2520 of material 2500. It is appreciated that control unit 2610 may physically include power source 2620, controller 2630 and input/output device 2640 in a common location as shown in FIG. 29, but alternatively, power source 2620, controller 2630 and input/output device 2640 may be physically distributed in other ways consistent with implementation of application 2600. Also, although wiring 2650 is shown as pairs of wires extending through material 2500(1) in FIG. 29, it is appreciated that power source 2620 may provide power through power and ground layers of material 2500(1) as shown in FIG. 30, and controller 2630 may provide control signals to individual wires that form wiring 2650 and operate motors as shown in FIG. 28. Application 2600 may be, for example, a resistance garment, and input/output device 2640 may include means for communicating with another resistance garment or with a base station in communication with several such resistance garments.

FIG. 30 is a cutaway schematic drawing of certain layers of an active material 2500(2), showing integration of length-adjusting elements 2520 and optional power supply layers 2512 and 2515 within the material. Material 2500(2) includes a backing fabric 2510(1) that in turn includes fibers 2730 (not all length-adjusting elements 2520 or fibers 2730 are labeled in FIG. 30, for clarity of illustration). Fibers 2730 may be any fibers within backing fabric 2510(1) and in particular may be strengthening fibers incorporated at intervals into a fabric 2510(1) that is not otherwise strong. Since as noted above a "backing fabric" may be fabric or may be other material with or without fibers, fibers 2730 may be incorporated into backing fabric by interweaving with fibers or by being embedded within such fibers and/or an amorphous material (e.g., rubber). Material 2500(2) also includes hems 2710 that may include reinforcing material sewn or bonded to backing fabric 2510(1). Hems 2710 may also include folded over portions of backing fabric 2510(1). Ends of length-adjusting elements 2520 anchor within hems 2710 so as to control dimensions of material 2500(2). Fibers 2730 weave about length-adjusting elements 2520 as schematically shown, to anchor length-adjusting elements 2520 within backing fabric 2510(1) but do not restrict movement of length-adjusting elements 2520 along their length. Outer covering 2720 is woven, stitched or otherwise bonded to backing fabric 2510(1) (without restricting movement of length-adjusting elements 2520 along their length), may be a waterproof layer, and may exist on one or both sides of active material 2500(2). Of course, in addition to fibers 2730 running in the (horizontal) direction shown in FIG. 30, additional fibers 2730 may be incorporated or woven into backing fabric 2510(1) in a different (e.g., vertical) direction, and in addition to the length-adjusting elements 2520 oriented (vertically) as shown in FIG. 30, additional length-adjusting elements 2520 may be included that run in a different (e.g., horizontal) direction, anchored in additional hems 2710 oriented vertically, so as to control dimensions of material 2500(2) in two dimensions. FIG. 30 shows optional power supply layer 2512 denoted with minus signs (–) and optional power supply layer 2515 denoted with plus signs (+) for illustrative purposes, but it is understood that layers 2512 and 2515 may be reversed in polarity as compared to what is shown. Power supply layers 2512 and 2515 may provide distribution of power throughout material 2500(2) for motors of length-adjusting elements 2520. Power supply layers 2512 and 2515 are useful, for example, to provide a continuous power source for motors 2530(3) (FIG. 28) to operate length-adjusting elements 2520, and are controlled by control wires 2562 (FIG. 28). Power supply layers 2512 and 2515 may sandwich around backing fabric 2510(1) as shown, or may both be on the same side thereof, with appropriate insulation to prevent layers 2512 and 2515 from shorting out with one another. When power supply layers 2512 and 2515 are not present in active material 2500(2), motors that operate length-adjusting elements 2520 may be, for example, motors 2530(1) (FIG. 26) and/or 2530(2) (FIG. 27) with power supplied as shown in FIGS. 26, 27 and 29

Figure 31:
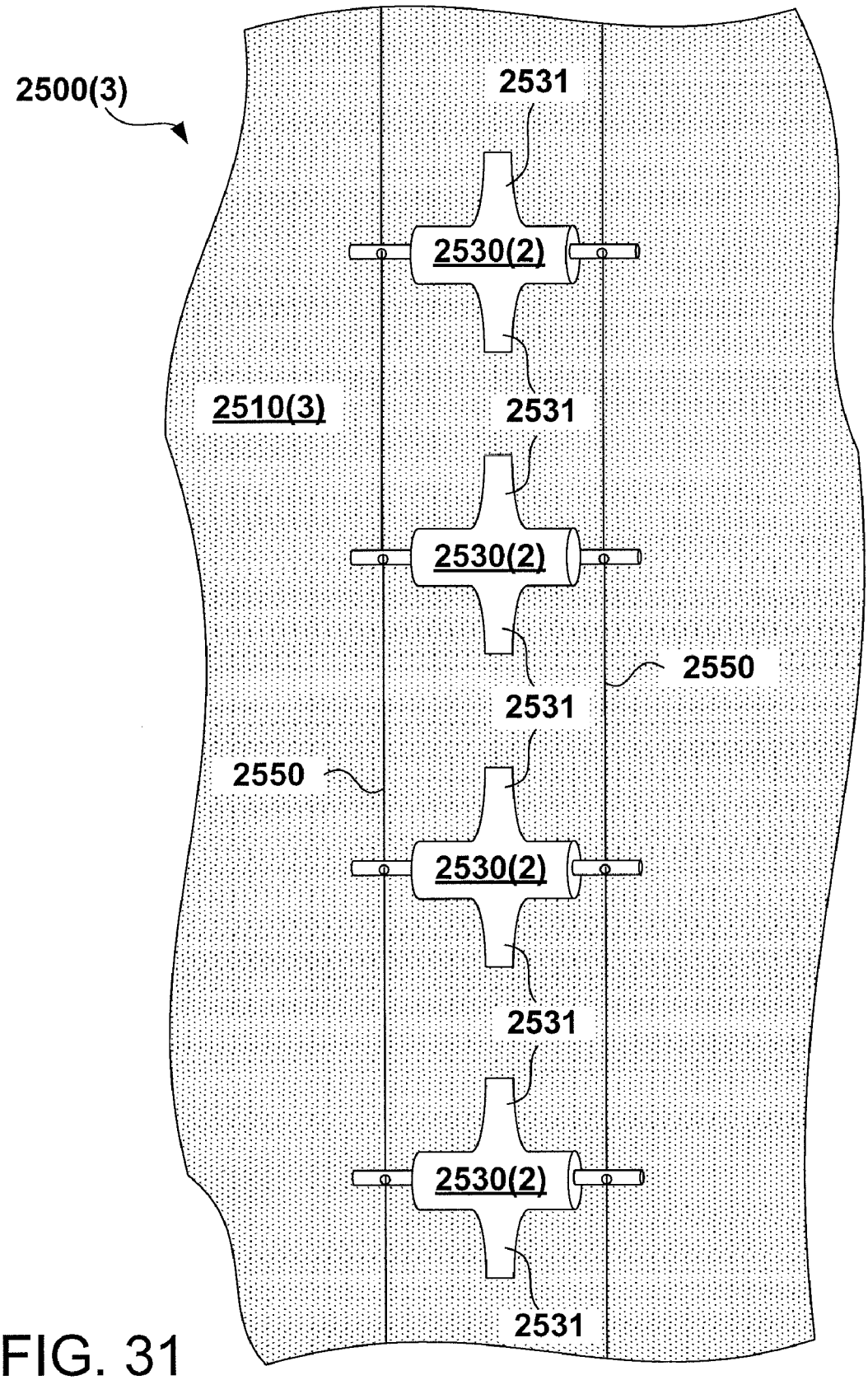

FIG. 31 illustrates a fragment of an active material 2500(3) that utilizes motors 2530(2) that include protrusions 2531 to anchor the motors to a backing fabric 2510(3). It is appreciated that motors that exert torque on a rotating shaft will themselves be subject to a force in the reverse direction as the shaft (as per Newton's Third Law). A means of fixing a body of the motor with respect to the fabric is advantageous so that the motor does not simply spin in place. For example, motors 2530(2) have protrusions 2531 that extend from the bodies thereof and lie along a surface of backing fabric 2510(3). Protrusions 2531 transmit the rotational force imparted to motors 2530(2) when their respective shafts rotate, so that motors 2530(2) do not spin in place. Protrusions 2531 may be bonded to backing fabric 2510(3) or may simply rest against it (e.g., when another fabric is layered atop motors 2530(2), for example by covering with a waterproof fabric like outer covering 2720, FIG. 30). Alternatively, it is appreciated that fibers of a backing fabric could be woven about corresponding cylindrical motors so tightly as to prevent their twisting within the backing fabric, even without protrusions 2531.

Figure 32:
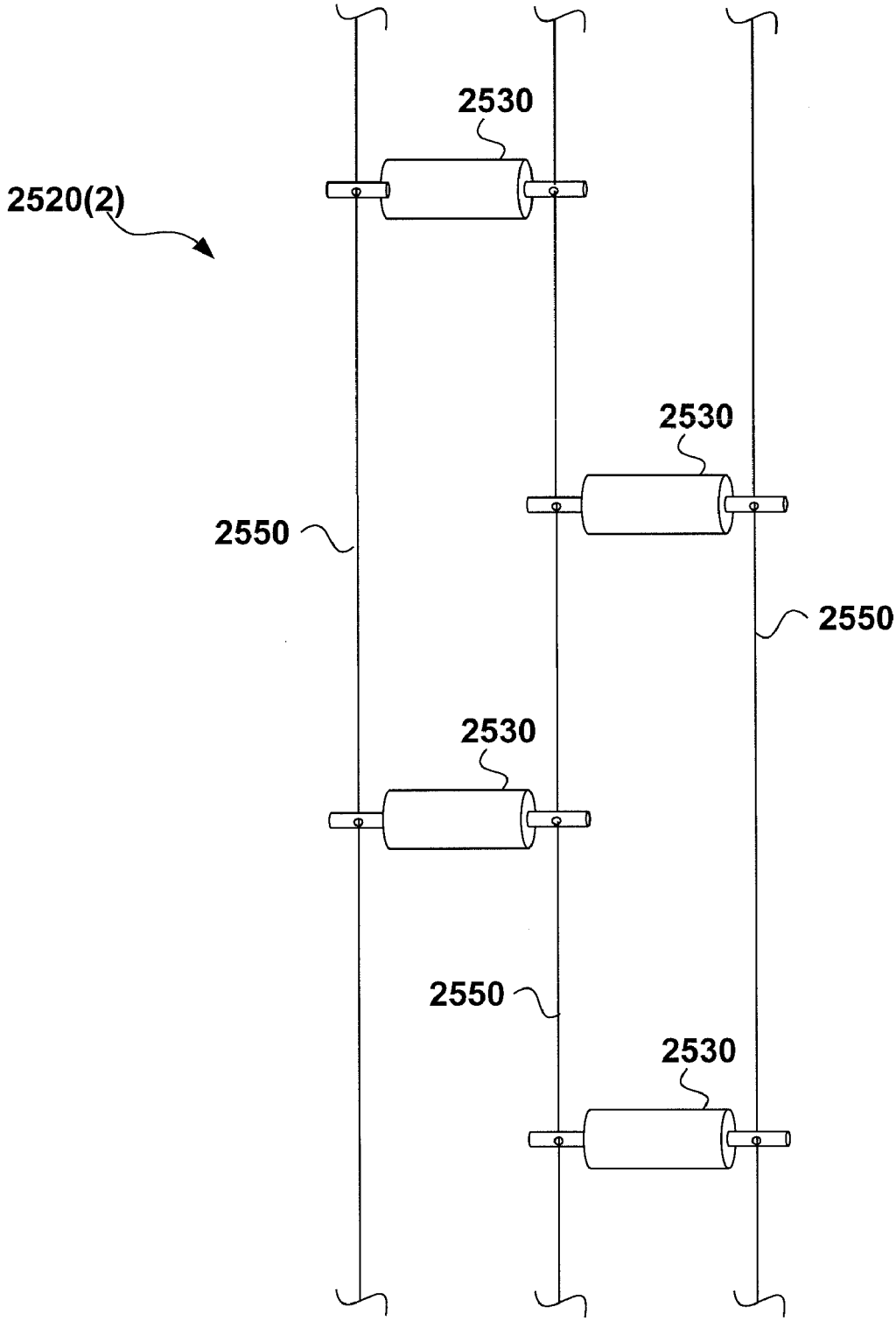
FIG. 32 illustrates a length-adjusting device that utilizes three filaments, and motors in a staggered arrangement with respect to each other and the filaments, in accord with an embodiment.

FIG. 32 illustrates a length-adjusting device 2520(2) that utilizes three filaments 2550, and motors 2530 in a staggered arrangement with respect to each other and the filaments. Motors 2530 may operate individually or in parallel to adjust an overall length of filaments 2550 and thus to adjust an overall length of an active material that includes the filaments. It is appreciated that a length-adjusting device may include any number of filaments 2550 and motors 2530 mounted between adjacent filaments.

Figure 33:
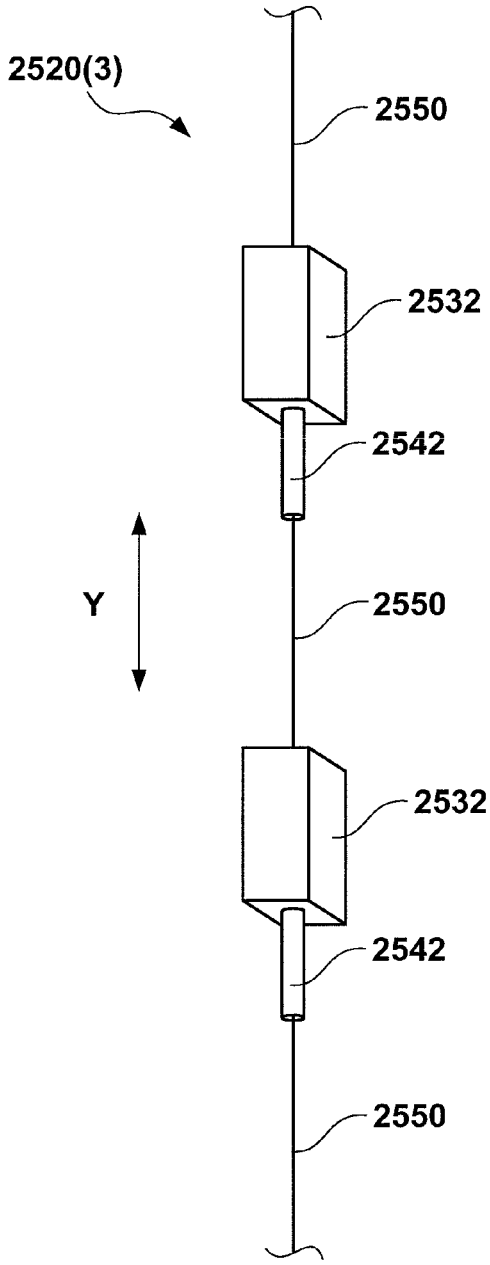
FIG. 33 illustrates a length-adjusting device that utilizes linear motors with discrete lengths of filament therebetween, in accord with an embodiment.

FIG. 33 illustrates a length-adjusting device 2520(3) that utilizes linear motors 2532 with discrete lengths of filament 2550 therebetween. Each linear motor 2532 includes a shaft 2542 that responds to applied power to extend or retract in the Y direction shown in FIG. 33, such that an effective length of filament 2550 increases or decreases respectively. Length-adjusting device 2520(3) may be implemented within an active material like previously illustrated length-adjusting devices 2520(1) and 2520(2), that is, ends of filaments 2550 may be anchored within hems or cuffs, and filaments 2550 and motors 2532 may be woven into backing fabrics that may be further encased with additional fabric layers for strength or waterproofing. Length-adjusting devices 2520(3) may be laid out in differing directions in an active material so as to control different dimensions of the active material. Each motor 2532 receives power through wiring, such as discussed above in connection with FIG. 29.

Figure 34:
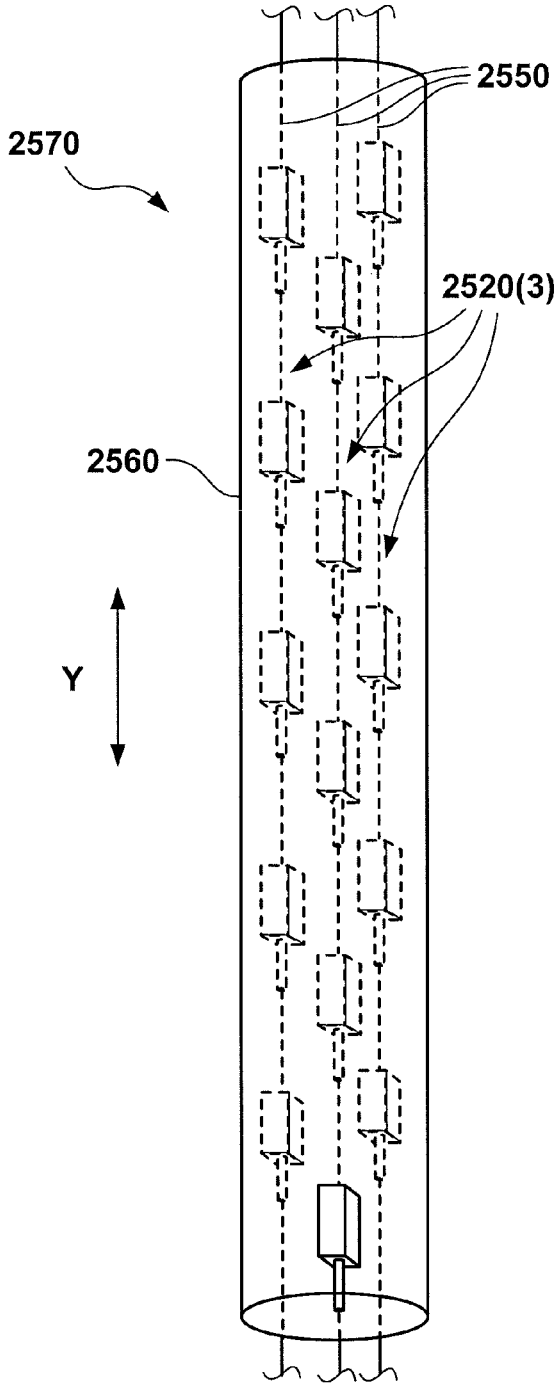
FIG. 34 illustrates an active cable that includes several length-adjusting devices as shown in FIG. 33, within an outer cover, in accord with an embodiment.

FIG. 34 illustrates an active cable 2570 that includes several length-adjusting devices 2520(3) (as shown in FIG. 33) within an outer cover 2560. A length of active cable 2570 may be adjusted by providing power to linear motors of length-adjusting devices 2520(3) such that effective lengths of respective filaments 2550 thereof shortens or lengthens. Outer cover 2560 may be waterproof. Upon reviewing FIG. 34 with FIGS. 25, 29 and 30, it will be appreciated that active cable 2570 is in many respects a one-dimensional analogue to two-dimensional active material 2500. Therefore in addition to length-adjusting devices 2520(3) and outer cover 2560, an active cable may include (a) provisions to connect motors of length-adjusting devices 2520(3) to power and ground, (b) other elastomeric and/or nonelastomeric fibers for anchoring and stabilizing length-adjusting devices 2520(3) with respect to outer cover 2560 and (c) hems to anchor ends of filaments 2550 to each other and to ends of outer cover 2560.

Figure 35:
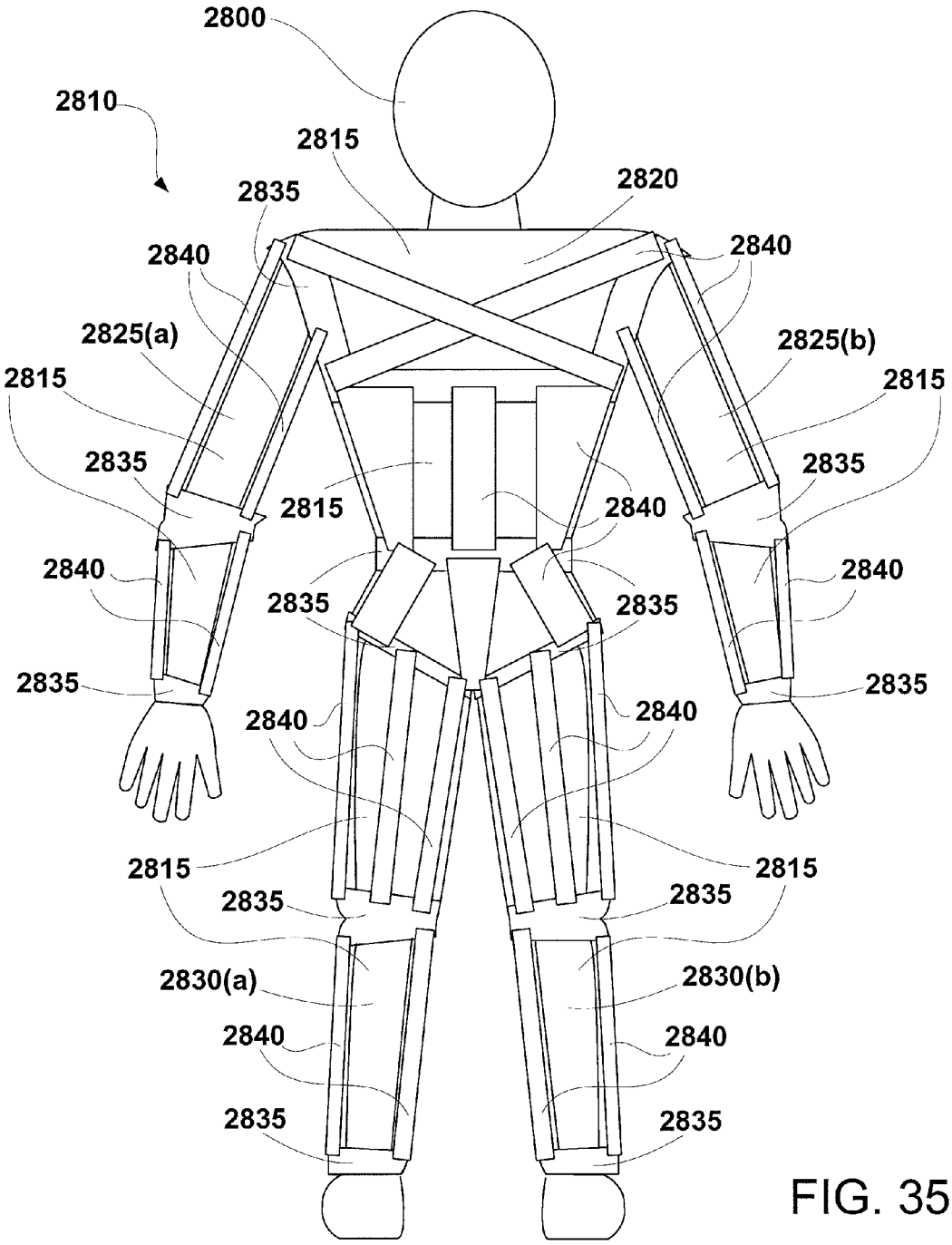
FIG. 35 is a schematic illustration of a human wearing an exoskeleton device that employs active material and/or active cable, in accord with an embodiment.

FIG. 35 is a schematic illustration of a human 2800 wearing an exoskeleton device 2810 that employs active material and/or active cable. Exoskeleton device 2810 includes rigid or semirigid body components 2815 that correspond at least approximately to a form of human 2800; device 2810 includes a torso 2820, arms 2825(*a*) and 2825(*b*) and legs 2830(*a*) and 2830(*b*) as shown, but it is contemplated that an exoskeleton device could have fewer, or more components 2815 (e.g., corresponding to hands, feet, head/neck) in embodiments. Body components 2815 may be connected with one another at joints 2835 that allow movement that is like natural human body movement at the corresponding locations. Active materials and/or active cables 2840 connect with components 2815. It is appreciated that means for powering and controlling active materials and/or active cables 2840 are provided (e.g., see FIGS. 26-30), but are not shown in FIG. 35 for clarity of illustration. Such means for powering and controlling may be accessible by human 2800 or may be controlled remotely.

Exoskeleton device 2810 may be utilized, for example, to provide powered assistance for movement, or resistance to movement, of human 2800. For example, exoskeleton device 2810 may assist human 2800 in performing physical tasks that he or she would not ordinarily have strength to perform. Alternatively, exoskeleton device 2810 may be utilized to provide resistance for such movement (e.g., as a resistance garment). It is appreciated that for certain body movements, assistance or resistance may be optimally provided by an active material that adjusts in two dimensions (e.g., as provided by active material 2500(1), FIG. 29) while for other body movements, assistance or resistance may require only adjustment in one dimensions (e.g., as provided by active cable 2570, FIG. 35). Furthermore, it is appreciated that number, size, and attachment points of active materials and/or active cables 2840 may vary from the example shown in FIG. 35. For example, although active materials and/or active cables 2840 are primarily shown as not overlapping in FIG. 35, for illustrative clarity, active materials and/or active cables 2840 may cross or overlap one another in embodiments.

Figure 36:
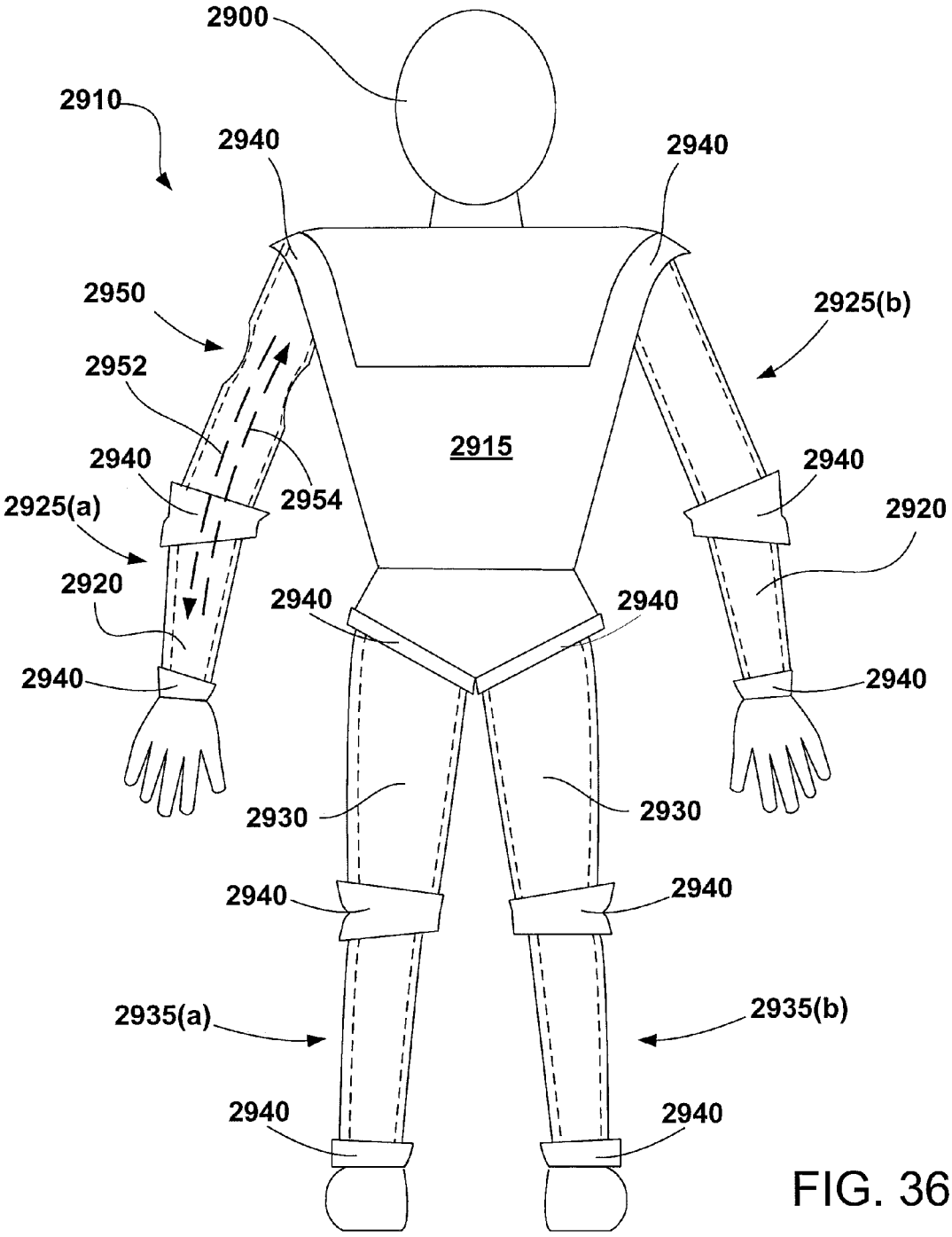
FIG. 36 is a schematic illustration of a human wearing a resistance garment that employs active material.

In addition to providing controllable resistance or powered assistance for movement, active materials can be implemented into resistance garments to provide a powered cardiovascular assistance mechanism. FIG. 36 is a schematic illustration of a human 2900 wearing a resistance garment 2910 that employs active material.

Resistance garment 2910 includes a torso 2915, sleeves 2925(*a*) and 2925(*b*) and legs 2935(*a*) and 2935(*b*) as shown, that correspond at least approximately to a form of human 2900. Arms 2920 and legs 2930 of human 2900 are shown as dashed lines within sleeves 2925 and legs 2935 of garment 2910. Garment 2910 also includes cuffs 2940 that correspond to joints of human 2900 such as shoulders, elbows, wrists, hips, knees and ankles.

Sleeves 2925 and legs 2935, and optionally cuffs 2935, include active materials that have length-adjusting devices (not labeled within FIG. 36) that substantially encircle arms 2920 and legs 2930 of human 2900. It is appreciated that means for powering and controlling the active materials are provided (e.g., see FIGS. 26-30), but are not shown in FIG. 36 for clarity of illustration. Such means for powering and controlling may be accessible by human 2900 or may be controlled remotely. Length-adjusting devices within cuffs 2940 may be utilized to help hold the cuffs in place on the corresponding joints of human 2900.

Resistance garment 2910 may be utilized, for example, to provide powered assistance for cardiovascular circulation of human 2900. That is, resistance garment 2910 may squeeze arms 2920 and legs 2930 of human 2900 so as to force blood circulation, taking advantage of the natural one-way valves of the circulatory system to move the blood in the usual directions of arterial and venous flow. For example, at location 2950 sleeve 2925(*a*) of resistance garment 2910 squeezes arm 2920 of human 2900 through contraction of length-adjusting elements of sleeve 2925(*a*) (e.g., length-adjusting elements 2520 of active materials, see FIGS. 24 through 33) that encircle arm 2920. The length-adjusting devices are controlled in sequence so that the squeezed portion of arm 2920 first ripples from the shoulder towards the wrist of human 2900 (e.g., outwardly, in the direction of dashed arrow 2952) to force blood into arm 2920. Subsequently, the length-adjusting devices are controlled in sequence so as to squeeze arm 2920 in the reverse direction (e.g., inwardly, in the direction of dashed arrow 2954) to force blood back towards a torso of human 2900. In this way, coordinated squeezing of arms 2920 and legs 2930 of human 2900 can significantly boost natural blood circulation and may be thought of as providing a "second heart" for human 2900.

From the preceding example, it will be appreciated that active materials may also be implemented with length-adjusting devices oriented in various ways to squeeze parts of a human body so as to provide massage, and that the position, timing and intensity of the squeezing may be controlled to substantially duplicate known massage techniques.

Figure 37:
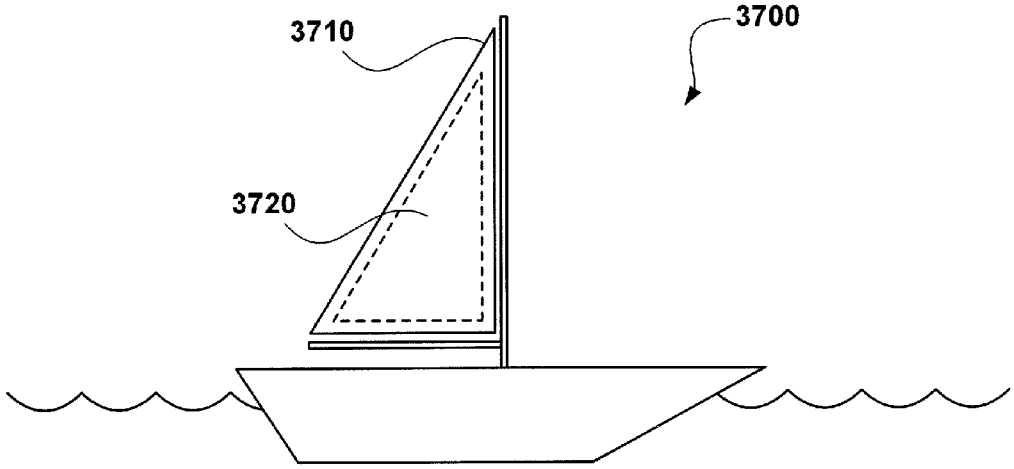
FIG. 37 shows a boat that incorporates an active material into a sail.
Figure 38:
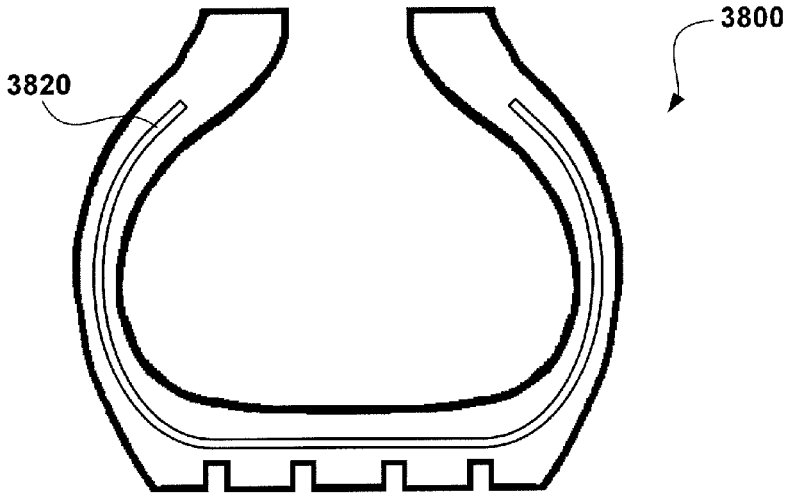
FIG. 38 is a schematic cross-section of a tire that incorporates an active material.

FIG. 37 shows a boat 3700 that incorporates an active material 3720 into a sail 3710. FIG. 38 is a schematic cross-section of a tire 3800 that incorporates an active material 3820.

It will be apparent to the skilled artisan that numbers, positioning and types of elements described herein may vary from what is expressly shown and described without departing from the spirit and scope of the resistance garments, active materials and active cables described herein. Therefore the changes described above, and others, may be made in the methods and systems described herein without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present methods and systems, which, as a matter of language, might be said to fall there between.

What is claimed is:

1. An active material, comprising:

a backing fabric; and one or more length-adjusting devices, each length-adjusting device including a first filament and a second filament that are interwoven with the backing fabric and substantially parallel with one another, and one or more motors, each motor driving first and second spooling elements that alternatively reel in or reel out portions of the first and second filaments, respectively, thereby adjusting (a) a length of the filaments, (b) a length of the length-adjusting device corresponding to the at least one motor, and (c) a length of the active material.

2. The active material of claim 1, further comprising means for transmitting power to the one or more motors, such that transmitting the power to at least one of the motors causes the at least one motor to reel in or reel out the portions of the filaments.

3. The active material of claim 2, the filaments comprising a conductive material as the means for transmitting power.

4. The active material of claim 2, the means for transmitting power comprising wires.

5. The active material of claim 2, further comprising a power supply that includes (a) a microprocessor that determines a magnitude of the power, and (b) circuitry responsive to the microprocessor to transfer the power from a power source.

6. The active material of claim 1, each of the one or more motors having a shaft extending therethrough, such that first and second shaft ends extend from the motor to drive the first and second spooling elements.

7. The active material of claim 6, the first and second shaft ends forming the first and second spooling elements respectively.

8. The active material of claim 7, each of the first and second shaft ends driving one of a spool and a reel to form the first and second spooling elements respectively.

9. The active material of claim 1, comprising a plurality of the length-adjusting devices, the filaments of at least one of the length-adjusting devices being oriented differently within the backing fabric than the filaments of another of the length-adjusting devices.

10. The active material of claim 1, comprising a plurality of the length-adjusting devices, wherein each of the motors is less than one millimeter in diameter and less than four millimeters in length, and the active material is incorporated into an article of clothing.

11. The active material of claim 10, comprising a quantity of the length-adjusting devices that forms a density of ten or more of the motors per square inch of the active material.

12. The active material of claim 1, comprising a plurality of the length-adjusting devices, wherein each of the motors has a diameter in a range of about 1 to 10 millimeters and a length of 5 to 50 millimeters, and the active material is incorporated into one of a tire and a sail.

13. The active material of claim 1, further comprising a waterproof layer.

14. The active material of claim 1, each of the motors comprising one or more protrusions such that each of the motors anchors within the backing fabric.

15. The active material of claim 1, wherein the backing fabric is tightly woven about each of the motors to anchor the motors within the backing fabric.

16. The active material of claim 1, the backing fabric comprising structural reinforcements that cooperate with an outer surface of one or more of the motors to anchor the one or more motors within the backing fabric.

17. The active material of claim 1, wherein at least one of the length-adjusting devices includes more filaments in addition to the first and second filaments, and at least one motor drives a spooling element that alternatively reels in or reels out the portions of each of the filaments.

18. An active cable, comprising a plurality of length- adjusting devices, each length-adjusting device including at least two portions of a filament, and a linear motor attached between the two portions in series, such that the motor alternatively increases or decreases a distance between the filaments, thereby adjusting (a) an overall length of the filament, (b) a length of the length-adjusting device corresponding to the motor, and (c) a length of the active cable.

19. An active material, comprising:

a backing fabric; and one or more length-adjusting devices, each length-adjusting device including at least two filament portions that are embedded within the backing fabric, and a linear motor attached between the two portions in series, such that the motor alternatively increases or decreases a distance between the filaments, thereby adjusting (a) an overall length of the filament, (b) a length of the length-adjusting device corresponding to the motor, and (c) a length of the active material.

* * * * *